US011552390B2

(12) United States Patent
Sethumadhavan et al.

(10) Patent No.: US 11,552,390 B2
(45) Date of Patent: Jan. 10, 2023

(54) DIELECTRIC RESONATOR ANTENNA SYSTEM

(71) Applicant: Rogers Corporation, Chandler, AZ (US)

(72) Inventors: Murali Sethumadhavan, Acton, MA (US); Michael S. White, Pomfret Center, CT (US); Gianni Taraschi, Arlington, MA (US); Kristi Pance, Auburndale, MA (US)

(73) Assignee: ROGERS CORPORATION, Chandler, AZ (US)

( * ) Notice: Subject to any disclaimer, the term of this patent is extended or adjusted under 35 U.S.C. 154(b) by 0 days.

(21) Appl. No.: 16/564,626

(22) Filed: Sep. 9, 2019

(65) Prior Publication Data

US 2020/0083602 A1 Mar. 12, 2020

Related U.S. Application Data

(60) Provisional application No. 62/729,521, filed on Sep. 11, 2018.

(51) Int. Cl.
*H01Q 13/00* (2006.01)
*H01Q 1/50* (2006.01)
(Continued)

(52) U.S. Cl.
CPC ..... *H01Q 1/50* (2013.01); *H01Q 13/02* (2013.01); *H01Q 9/0485* (2013.01); *H01Q 15/08* (2013.01);
(Continued)

(58) Field of Classification Search
CPC ..... H01Q 1/50; H01Q 13/02; H01Q 9/0485; H01Q 21/0006; H01Q 15/08; H01Q 19/08
See application file for complete search history.

(56) References Cited

U.S. PATENT DOCUMENTS 2,624,002 A 10/1952 Bouix
3,212,454 A 10/1965 Ringenbach
(Continued)

FOREIGN PATENT DOCUMENTS

CN 102130376 7/2011
CN 102130377 A 7/2011
(Continued)

OTHER PUBLICATIONS

Buerkle, A. et al; "Fabrication of a DRA Array Using Ceramic Stereolithography"; IEEE Antennas and Wireless Popagation Letters; IEEE; vol. 5,, No. 1, Jan. 2007; pp. 479-481.
(Continued)

*Primary Examiner* — Joseph J Lauture
(74) *Attorney, Agent, or Firm* — Cantor Colburn LLP

(57) ABSTRACT

An electromagnetic device includes: an electrically conductive ground structure; at least one dielectric resonator antenna (DRA) disposed on the ground structure; at least one electromagnetic (EM) beam shaper disposed proximate a corresponding one of the DRA; and, at least one signal feed disposed electromagnetically coupled to a corresponding one of the DRA. The at least one EM beam shaper having: an electrically conductive horn; a body of dielectric material having a dielectric constant that varies across the body of dielectric material in a specific direction; or, both the electrically conductive horn and the body of dielectric material.

25 Claims, 17 Drawing Sheets

(51) Int. Cl.

| | |
|---|---|
| ***H01Q 13/02*** | (2006.01) |
| *H01Q 19/08* | (2006.01) |
| *H01Q 9/04* | (2006.01) |
| *H01Q 21/00* | (2006.01) |
| *H01Q 15/08* | (2006.01) |

(52) U.S. Cl.
CPC ..... *H01Q 19/08* (2013.01); *H01Q 21/0006* (2013.01)

(56) References Cited

U.S. PATENT DOCUMENTS 3,255,453 A 6/1966 Horst
3,321,765 A 5/1967 Peters et al.
3,321,821 A 5/1967 Horst
4,274,097 A 6/1981 Krall et al.
4,288,795 A 9/1981 Shelton
4,366,484 A 12/1982 Weiss et al.
4,458,249 A 7/1984 Valentino et al.
4,575,330 A 3/1986 Hull
4,929,402 A 5/1990 Hull
4,983,910 A 1/1991 Majidi-Ahy et al.
5,061,943 A 10/1991 Rammos
5,104,592 A 4/1992 Hull et al.
5,125,111 A 6/1992 Trinh
5,184,307 A 2/1993 Hull et al.
5,192,559 A 3/1993 Hull et al.
5,227,749 A 7/1993 Raguenet et al.
5,234,636 A 8/1993 Hull et al.
5,236,637 A 8/1993 Hull
5,273,691 A 12/1993 Hull et al.
5,453,754 A 9/1995 Fray
5,476,749 A 12/1995 Steinmann et al.
5,589,842 A 12/1996 Wang et al.
5,667,796 A 9/1997 Otten
5,677,796 A 10/1997 Zimmerman et al.
5,828,271 A * 10/1998 Stitzer ..... H01P 1/195 333/24.1
5,854,608 A 12/1998 Leisten
5,867,120 A 2/1999 Ishikawa et al.
5,940,036 A 8/1999 Oliver et al.
5,943,005 A 8/1999 Tanizaki et al.
5,952,972 A 9/1999 Ittipiboon et al.
6,008,755 A 12/1999 Ishikawa et al.
6,031,433 A 2/2000 Tanizaki et al.
6,052,087 A 4/2000 Ishikawa et al.
6,061,031 A 5/2000 Cosenza et al.
6,075,492 A 6/2000 Schmidt et al.
6,076,324 A 6/2000 Daily et al.
6,133,887 A 10/2000 Tanizaki et al.
6,147,647 A 11/2000 Tassoudji et al.
6,181,297 B1 1/2001 Leisten
6,188,360 B1 2/2001 Kato et al.
6,198,450 B1 3/2001 Adachi et al.
6,268,833 B1 7/2001 Tanizaki et al.
6,292,141 B1 9/2001 Lim
6,314,276 B1 11/2001 Hilgers et al.
6,317,095 B1 11/2001 Teshirogi et al.
6,323,808 B1 11/2001 Heinrichs et al.
6,323,824 B1 11/2001 Heinrichs et al.
6,344,833 B1 2/2002 Lin et al.
6,373,441 B1 4/2002 Porath et al.
6,437,747 B1 8/2002 Stoiljkovic et al.
6,476,774 B1 11/2002 Davidson et al.
6,552,687 B1 4/2003 Rawnick et al.
6,556,169 B1 4/2003 Fukuura et al.
6,621,381 B1 9/2003 Kundu et al.
6,743,744 B1 6/2004 Kim et al.
6,794,324 B1 9/2004 Kim et al.
6,816,118 B2 11/2004 Kingsley et al.
6,816,128 B1 11/2004 Jennings
6,855,478 B2 2/2005 DeVoe et al.
7,161,535 B2 1/2007 Palmer et al.
7,179,844 B2 2/2007 Aki
7,183,975 B2 2/2007 Thomas et al.
7,196,663 B2 3/2007 Bozer et al.
7,253,789 B2 8/2007 Kingsley et al.
7,292,204 B1 11/2007 Chang et al.
7,310,031 B2 12/2007 Pance et al.
7,355,560 B2 4/2008 Nagai
7,379,030 B1 * 5/2008 Lier ..... H01Q 13/00 343/772
7,382,322 B1 6/2008 Yang et al.
7,443,363 B2 10/2008 Ying
7,498,969 B1 3/2009 Paulsen et al.
7,534,844 B2 5/2009 Lee et al.
7,545,327 B2 6/2009 Iellici et al.
7,550,246 B2 6/2009 Fukuzumi et al.
7,570,219 B1 8/2009 Paulsen et al.
7,595,765 B1 9/2009 Hirsch et al.
7,636,063 B2 12/2009 Channabasappa
7,649,029 B2 1/2010 Kolb et al.
7,663,553 B2 2/2010 Chang et al.
7,688,263 B1 3/2010 Oxley
7,710,325 B2 5/2010 Cheng
7,767,728 B2 8/2010 Lu et al.
7,796,080 B1 9/2010 Lynch et al.
7,824,839 B2 11/2010 Ober et al.
7,835,600 B1 11/2010 Yap et al.
7,935,476 B2 5/2011 Teng
7,961,148 B2 6/2011 Goldberger
8,018,397 B2 9/2011 Jow et al.
8,098,187 B1 1/2012 Lynch et al.
8,098,197 B1 1/2012 Herting et al.
19,214 A1 2/2012 Schwantes et al.
8,232,043 B2 7/2012 Williamson et al.
8,498,539 B1 7/2013 Iichenko et al.
8,736,502 B1 5/2014 Langfield et al.
8,773,319 B1 7/2014 Anderson et al.
8,902,115 B1 12/2014 Loui et al.
9,112,273 B2 8/2015 Christie et al.
9,205,601 B2 12/2015 Desimone et al.
9,225,070 B1 12/2015 Zeweri et al.
9,583,837 B2 2/2017 Xue et al.
9,608,330 B2 3/2017 Singleton et al.
9,825,373 B1 11/2017 Smith
9,930,668 B2 3/2018 Barzegar et al.
10,355,361 B2 7/2019 Pance et al.
10,522,917 B2 12/2019 Pance et al.
10,587,039 B2 3/2020 Pance et al.
11,108,159 B2 8/2021 Pance et al.
2001/0013842 A1 8/2001 Ishikawa et al.
2002/0000947 A1 1/2002 Al-Rawi et al.
2002/0057138 A1 5/2002 Takagi et al.
2002/0067317 A1 6/2002 Sakurada
2002/0149108 A1 10/2002 Ahn et al.
2002/0180646 A1 12/2002 Kivekas et al.
2002/0196190 A1 12/2002 Lim
2003/0016176 A1 1/2003 Kingsley et al.
2003/0034922 A1 2/2003 Isaacs et al.
2003/0043075 A1 3/2003 Bit-Babik et al.
2003/0043086 A1 3/2003 Schaffner et al.
2003/0122729 A1 7/2003 Diaz et al.
2003/0151548 A1 8/2003 Kingsley et al.
2003/0181312 A1 9/2003 Mailadil et al.
2004/0029709 A1 2/2004 Oba et al.
2004/0029985 A1 2/2004 Aki et al.
2004/0036148 A1 2/2004 Block et al.
2004/0051602 A1 3/2004 Pance et al.
2004/0113843 A1 6/2004 Le Bolzer et al.
2004/0119646 A1 6/2004 Ohno et al.
2004/0127248 A1 7/2004 Lin et al.
2004/0130489 A1 7/2004 Le Bolzer et al.
2004/0155817 A1 8/2004 Kingsley et al.
2004/0233107 A1 11/2004 Popov et al.
2004/0263422 A1 12/2004 Lynch
2005/0017903 A1 1/2005 Ittipiboon et al.
2005/0024271 A1 2/2005 Ying et al.
2005/0099348 A1 5/2005 Pendry
2005/0122273 A1 6/2005 Legay et al.
2005/0154567 A1 7/2005 Jackman et al.
2005/0162316 A1 7/2005 Thomas et al.
2005/0162733 A1 7/2005 Cho et al.
2005/0179598 A1 8/2005 Legay et al.

(56) References Cited

U.S. PATENT DOCUMENTS

2005/0219130 A1 10/2005 Koch et al.
2005/0225499 A1 10/2005 Kingsley et al.
2005/0242996 A1 11/2005 Palmer et al.
2005/0248421 A1 11/2005 Joodaki
2005/0264449 A1 12/2005 Strickland
2005/0264452 A1 12/2005 Fujishima et al.
2006/0022875 A1 2/2006 Pidwerbetsky et al.
2006/0119518 A1 6/2006 Ohmi et al.
2006/0145705 A1 7/2006 Raja
2006/0194690 A1 8/2006 Osuzu
2006/0220958 A1 10/2006 Saegrov
2006/0232474 A1 10/2006 Fox
2006/0293651 A1 12/2006 Cronin
2007/0067058 A1 3/2007 Miyamoto et al.
2007/0152884 A1 7/2007 Bouche et al.
2007/0164420 A1 7/2007 Chen et al.
2007/0252778 A1 11/2007 Ide et al.
2008/0036675 A1 2/2008 Fujieda
2008/0042903 A1 2/2008 Cheng
2008/0048915 A1 2/2008 Chang et al.
2008/0079182 A1 4/2008 Thompson et al.
2008/0094309 A1 4/2008 Pance et al.
2008/0122703 A1 5/2008 Ying
2008/0129616 A1 6/2008 Li et al.
2008/0129617 A1 6/2008 Li et al.
2008/0019195 A1 8/2008 Tokoro et al.
2008/0193749 A1 8/2008 Thompson et al.
2008/0202720 A1 8/2008 Wagstaff
2008/0260323 A1 10/2008 Jalali et al.
2008/0272963 A1 11/2008 Chang et al.
2008/0278378 A1 11/2008 Chang et al.
2009/0040131 A1 2/2009 Mosallaei
2009/0073332 A1 3/2009 Irie
2009/0102739 A1 4/2009 Chang et al.
2009/0128262 A1 5/2009 Lee et al.
2009/0128434 A1 5/2009 Chang et al.
2009/0140944 A1 6/2009 Chang et al.
2009/0153403 A1 6/2009 Chang et al.
2009/0179810 A1 7/2009 Kato et al.
2009/0184875 A1 7/2009 Chang et al.
2009/0206957 A1 8/2009 Hiroshima et al.
2009/0262022 A1 10/2009 Ying
2009/0270244 A1 10/2009 Chen et al.
2009/0305652 A1 12/2009 Boffa et al.
2010/0002312 A1 1/2010 Duparre et al.
2010/0051340 A1 3/2010 Yang et al.
2010/0103052 A1 4/2010 Ying
2010/0220024 A1 9/2010 Snow et al.
2010/0231452 A1 9/2010 Babakhani et al.
2011/0012807 A1 1/2011 Sorvala
2011/0050367 A1 3/2011 Yen et al.
2011/0121258 A1 5/2011 Hanein et al.
2011/0122036 A1 5/2011 Leung et al.
2011/0133991 A1 6/2011 Lee et al.
2011/0204531 A1 8/2011 Hara et al.
2011/0248890 A1 10/2011 Lee et al.
2012/0045619 A1 2/2012 Ando et al.
2012/0092219 A1 4/2012 Kim
2012/0212386 A1 8/2012 Massie et al.
2012/0242553 A1 9/2012 Leung et al.
2012/0245016 A1 9/2012 Curry et al.
2012/0256796 A1 10/2012 Leiba
2012/0274523 A1 11/2012 Ayatollahi
2012/0276311 A1 11/2012 Chirila
2012/0280380 A1 11/2012 Kamgaing
2012/0287008 A1 11/2012 Kim
2012/0306713 A1 12/2012 Raj et al.
2012/0329635 A1 12/2012 Hill
2013/0076570 A1 3/2013 Lee et al.
2013/0088396 A1 4/2013 Han
2013/0113674 A1 5/2013 Ryu
2013/0120193 A1 5/2013 Hoppe et al.
2013/0127669 A1 5/2013 Han et al.
2013/0234898 A1 9/2013 Leung et al.
2014/0043189 A1 2/2014 Lee et al.
2014/0091103 A1 4/2014 Neitzel
2014/0327597 A1 11/2014 Rashidian et al.
2015/0035714 A1 2/2015 Zhou
2015/0070230 A1 3/2015 Bradley et al.
2015/0138036 A1 4/2015 Harper
2015/0183167 A1 7/2015 Molinari et al.
2015/0207233 A1 7/2015 Kim et al.
2015/0207234 A1 7/2015 Ganchrow et al.
2015/0236428 A1 8/2015 Caratelli et al.
2015/0244082 A1 8/2015 Caratelli et al.
2015/0266244 A1 9/2015 Page
2015/0303546 A1 10/2015 Rashidian et al.
2015/0314526 A1 11/2015 Cohen
2015/0346334 A1 12/2015 Nagaishi et al.
2015/0380824 A1 12/2015 Tayfeh Aligodarz et al.
2016/0036132 A1 2/2016 Board
2016/0107290 A1 4/2016 Bajaj et al.
2016/0111769 A1 4/2016 Pance et al.
2016/0218437 A1 7/2016 Guntupalli et al.
2016/0219976 A1 8/2016 Guyan
2016/0263823 A1 9/2016 Espiau
2016/0294066 A1 10/2016 Djerafi et al.
2016/0294068 A1 10/2016 Djerafi et al.
2016/0313306 A1 10/2016 Ingber et al.
2016/0314431 A1 10/2016 Quezada
2016/0322708 A1 11/2016 Tayfeh Aligodarz et al.
2016/0372955 A1 12/2016 Fackelmeier et al.
2017/0018851 A1 1/2017 Henry et al.
2017/0040700 A1 2/2017 Leung et al.
2017/0062944 A1 3/2017 Zimmerman et al.
2017/0110804 A1 4/2017 Henry et al.
2017/0125901 A1 5/2017 Sharawi et al.
2017/0125908 A1* 5/2017 Pance ..... H01Q 9/0485
2017/0125909 A1 5/2017 Pance et al.
2017/0125910 A1 5/2017 Pance et al.
2017/0179569 A1 6/2017 Kim et al.
2017/0188874 A1 7/2017 Suhami
2017/0201026 A1* 7/2017 Werner ..... H01Q 1/48
2017/0225395 A1 8/2017 Boydston et al.
2017/0271772 A1 9/2017 Miraftab et al.
2017/0272149 A1 9/2017 Michaels
2017/0324171 A1 11/2017 Shehan
2017/0360534 A1 12/2017 Sun
2018/0007746 A1 1/2018 Smith
2018/0090815 A1 3/2018 Shirinfar et al.
2018/0115072 A1 4/2018 Pance et al.
2018/0183150 A1 6/2018 Sienkiewicz et al.
2018/0241129 A1 8/2018 Pance et al.
2018/0282550 A1 10/2018 Ofs
2018/0309202 A1 10/2018 Pance et al.
2018/0323514 A1 11/2018 Pance et al.
2019/0020105 A1 1/2019 Pance et al.
2019/0115668 A1 4/2019 Coward et al.
2019/0128624 A1 5/2019 Cohen et al.
2019/0214732 A1 7/2019 Leung et al.
2019/0288360 A1 9/2019 Hendry
2019/0319357 A1 10/2019 Pance et al.
2019/0379123 A1 12/2019 Leung et al.
2019/0393607 A1 12/2019 Pance et al.
2020/0083609 A1 3/2020 Pance et al.
2020/0083610 A1* 3/2020 Pance ..... H01Q 21/0006
2020/0122387 A1 4/2020 Polidore et al.
2020/0227827 A1 7/2020 Vollmer et al.
2021/0328356 A1 10/2021 Polidore et al.

FOREIGN PATENT DOCUMENTS

CN 104037505 A 9/2014
CN 105390809 A 3/2016
CN 105490005 A 4/2016
CN 110380230 A 10/2019
CN 216288983 U 4/2022
EP 0587247 A1 3/1994
EP 0801436 A2 10/1997
EP 1783516 A1 5/2007
EP 2905632 A1 8/2015
GB 2050231 A 1/1981
JP H0665334 A 3/1994
JP 07154114 A 6/1995

(56) References Cited

FOREIGN PATENT DOCUMENTS

| | | | |
|---|---|---|---|
| JP | 2004112131 | A | 4/2004 |
| JP | 2013211841 | A | 10/2010 |
| RU | 2660385 | | 7/2018 |
| WO | 9513565 | A1 | 5/1995 |
| WO | 0076028 | A1 | 12/2000 |
| WO | 2012129968 | A1 | 10/2012 |
| WO | 2014100462 | A1 | 6/2014 |
| WO | 2014126837 | A2 | 8/2014 |
| WO | 2015102938 | A1 | 7/2015 |
| WO | 2016153711 | A1 | 9/2016 |
| WO | 2017040883 | A1 | 3/2017 |
| WO | 2017075177 | A1 | 5/2017 |
| WO | 2017075184 | A1 | 5/2017 |
| WO | 2017090401 | A1 | 6/2017 |
| WO | 2018010443 | A1 | 1/2018 |
| WO | 2017075186 | A1 | 5/2018 |
| WO | 2018226657 | A1 | 12/2018 |

OTHER PUBLICATIONS

Guo, Yomg-Xin, et al.,; "Wide-Band Stacked Double Annular-Ring Dielectric Resonator Antenna at the End-Fire Mode Operation"; IEEE Transacions on Antennas and Propagation; vol. 53; No. 10; Oct. 2005; 3394-3397 pages.

Kakade, A.B., et al; "Analysis of the Rectangular Waveguide Slot Coupled Multilayer hemispherical Dielectric Resonator Antenna"; IET Microwaves, Antennas & Propagation, The Institution of Engineering and Technology; vol. 6; No. 3; Jul. 11, 2011; 338-347 pages.

Kakade, Anandrao, et al.; Mode Excitation in the Coaxial Probe Coupled Three-Layer Hemispherical Dielectric Resonator Antenna; IEEE Transactions on Antennas and Propagation; vol. 59; No. 12; Dec. 2011; 7 pages.

Petosa, Aldo, et al.; "Dielectric Resonator Antennas: A Historical Review and the Current State of the Art"; IEEE Antennas and Propagation Magazine; vol. 52, No. 5, Oct. 2010; 91-116 pages.

Wong, Kin-Lu, et al.,; "Analysis of a Hemispherical Dielectric Resonator Antenna with an Airgap"; IEEE Microwave and Guided Wave Letters; vol. 3; No. 9; Oct. 3, 1993; 355-357 pages.

Zainud-Deen, S H et al; "Dielectric Resonator Antenna Phased Array for Fixed RFID Reader in Near Field Region"; IEEE; Mar. 6, 2012; pp. 102-107.

Atabak Rashidian et al; "Photoresist-Based Polymer Resonator Antennas: Lithography Fabrication, Strip-Fed Excitation, and Multimode Operation", IEEE Antennas and Propagation Magazine, IEEE Service Center; vol. 53, No. 4, Aug. 1, 2011; 16-27 pages.

"New 3D Printed Electromagnetic Lense from OmniPreSense"; URL: http://www.microwavejournal.com/articles/31133-new-3d-printed-electromagnetic-lens-from-omnipresense; Date of Access: Oct. 16, 2018; 8 pages.

"Photoacid Generator Selection Guide for the electronics industry and energy curable coatings" (BASF 2010).

Keysight Technologies; "Split Post Dielectric Resonators for Dielectric Measurements of Substrates"; Keysight Technologies, Dec. 2, 2017; 5989-5384EN, pp. 1-11.

Krupka et al.; "Split post dielectric resonator technique for precise measurements of laminar dielectric specimens—Measurement uncertainties"; IEEE Xplore Conference Paper Feb. 2000, pp. 305-308.

Krupka J., Gregory A.P., Rochard O.C., Clarke R.N., Riddle B., Baker-Jarvis J., Uncertainty of Complex Permittivity Measurement by Split-Post Dielectric Resonator Techniques, Journal of the European Ceramic Society, No. 10, pp. 2673-2676, 2001.

Krupka, J., Geyer, R.G., Baker-Jarvis, J., Ceremuga, J., Measurements of the complex permittivity of microwave circuit board substrates using split dielectric resonator and reentrant cavity techniques. Seventh International Conference on Dielectric Materials, Measurements and Applications, (Conf. Publ. No. 430), pp. 21-24, Sep. 1996.

Lei, Juan et al., "Experimental demonstration of conformal phased array antenna via transformation optics," Scientific Reports, vol. 8, No. 1, Feb. 28, 2018, 14 pages.

Liang, M. et al.; "A 3-D Luneburg lens antenna fabricated by polymer jetting rapid prototyping," IEEE Transactions on Antennas and Propagation, 62(4), Apr. 2014, 1799-1807.

Zainud-Deen SH et al: 'High Directive Dielectric resonator antenna over curved ground plane using metamaterials, National Radio Science Conference IEEE, Apr. 26, 2011 pp. 1-9.

Boriskin et al. "Integrated Lens Antennas" In: "Aperture Antennas for Millimeter and Sub-Millimeter Wave Applications", Sep. 8, 2017, International Publishing, pp. 3-36.

Elboushi A. et al., "High Gain Hybrid DRA/Horn antenna for MMW Applications", Concordia Universitiy; 2014 IEEE; 2 pages.

Hesselbarth et al., "Millimeter-wave front-end integration concept using beam-switched lens antenna", 2016 10th European Conference on Antennas and Propagation, European Assoc. of Antennas and Propagation, Apr. 10, 2016; pp. 1-5.

Tang, W. et al., "Discrete Coordinate Transformation for Designing All-Dielectric Flat Antennas", IEEE Transactions on Antennas and Propagation, vol. 58, No. 12, Dec. 2010 pp. 3795-3804.

Thornton et al., "Introduction" In: "Modern Lens Antennas for Communications Engineering", Jan. 1, 2013 John Wiley & Sons, Inc. pp. 1-48.

* cited by examiner

| Name | Theta | Ang | Mag |
|---|---|---|---|
| m1 | 360.0000 | -0.0000 | 21.4339 |
| m2 | 0.0000 | 0.0000 | 9.2694 |

| Curve Info | |
|---|---|
| - - - - | dB(RealizedGainTotal)<br>Setup1 : LastAdaptive<br>Freq = '77GHz' Phi = '90deg' |
| ——— | dB(RealizedGainTotal)_1<br>Imported<br>Freq = '77GHz' Phi = '90deg' |

DIELECTRIC RESONATOR ANTENNA SYSTEM

CROSS REFERENCE TO RELATED APPLICATIONS

This application claims the benefit of U.S. Provisional Application Ser. No. 62/729,521, filed Sep. 11, 2018, which is incorporated herein by reference in its entirety.

BACKGROUND OF THE INVENTION

The present disclosure relates generally to an electromagnetic device, particularly to a dielectric resonator antenna (DRA) system, and more particularly to a DRA system with an electromagnetic beam shaper for enhancing the gain, collimation and directionality of a DRA within the DRA system, which is well suited for microwave and millimeter wave applications.

While existing DRA resonators and arrays may be suitable for their intended purpose, the art of DRAs would be advanced with an electromagnetic device useful for building a high gain DRA system with high directionality in the far field that may overcome existing drawbacks, such as limited bandwidth, limited efficiency, limited gain, limited directionality, or complex fabrication techniques, for example.

BRIEF DESCRIPTION OF THE INVENTION

An embodiment includes an electromagnetic device, comprising: an electrically conductive ground structure; at least one dielectric resonator antenna (DRA) disposed on the ground structure; at least one electromagnetic (EM) beam shaper disposed proximate a corresponding one of the DRA; and, at least one signal feed disposed electromagnetically coupled to a corresponding one of the DRA. The at least one EM beam shaper comprises: an electrically conductive horn; a body of dielectric material having a dielectric constant that varies across the body of dielectric material in a specific direction; or, both the electrically conductive horn and the body of dielectric material.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claimed invention.

Embodiments disclosed herein include different arrangements for an EM device useful for building a high gain DRA system with high directionality in the far field. An embodiment of an EM device as disclosed herein includes one or more DRAs that may be singly fed, selectively fed, or multiply fed by one or more signal feeds, and may include at least one EM beam shaper disposed proximate a corresponding one of the DRAs in such a manner as to increase the gain and directionality of the far field radiation pattern over a DRA system absent such an EM beam shaper. Example EM beam shapers include an electrically conductive horn, and a body of dielectric material such as a Luneburg lens, which will now be discussed in combination with the several figures provided herewith.

Figure 1B:
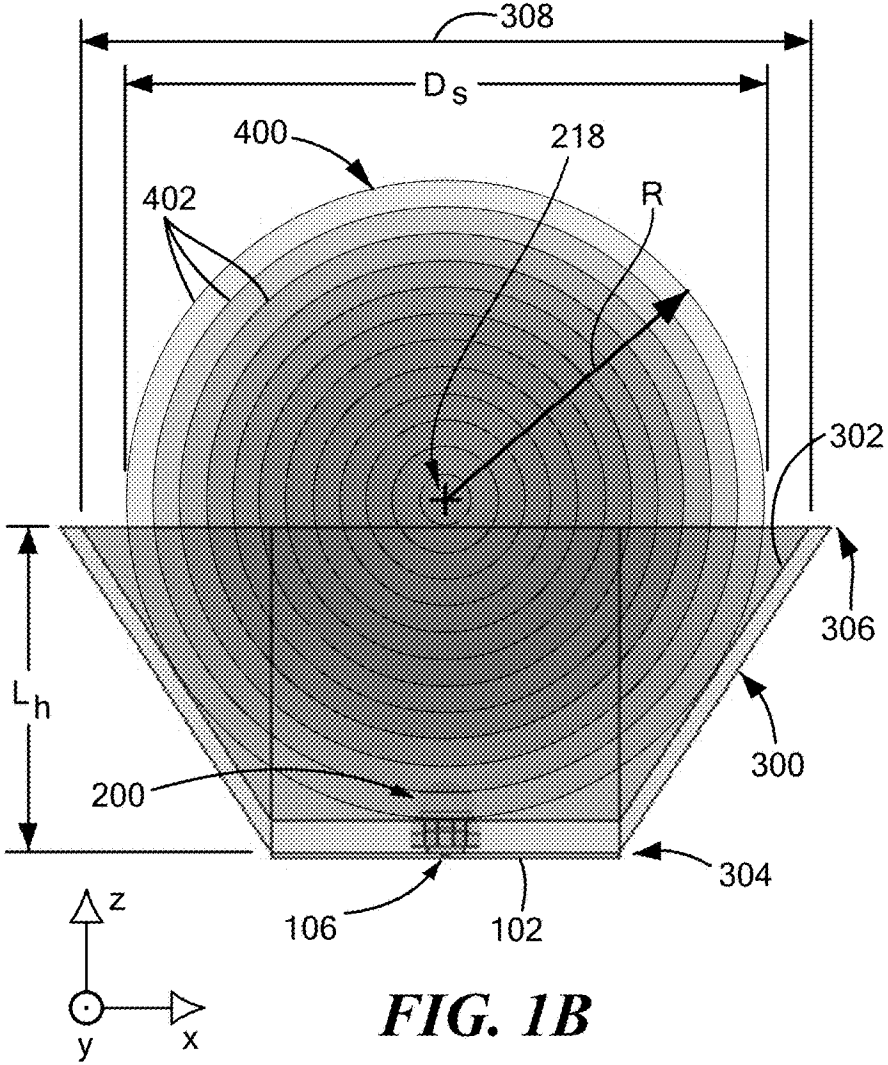
FIG. 1B depicts an elevation view cross section through section line 1B-1B of the electromagnetic device of FIG. 1A, in accordance with an embodiment.
Figure 1A:
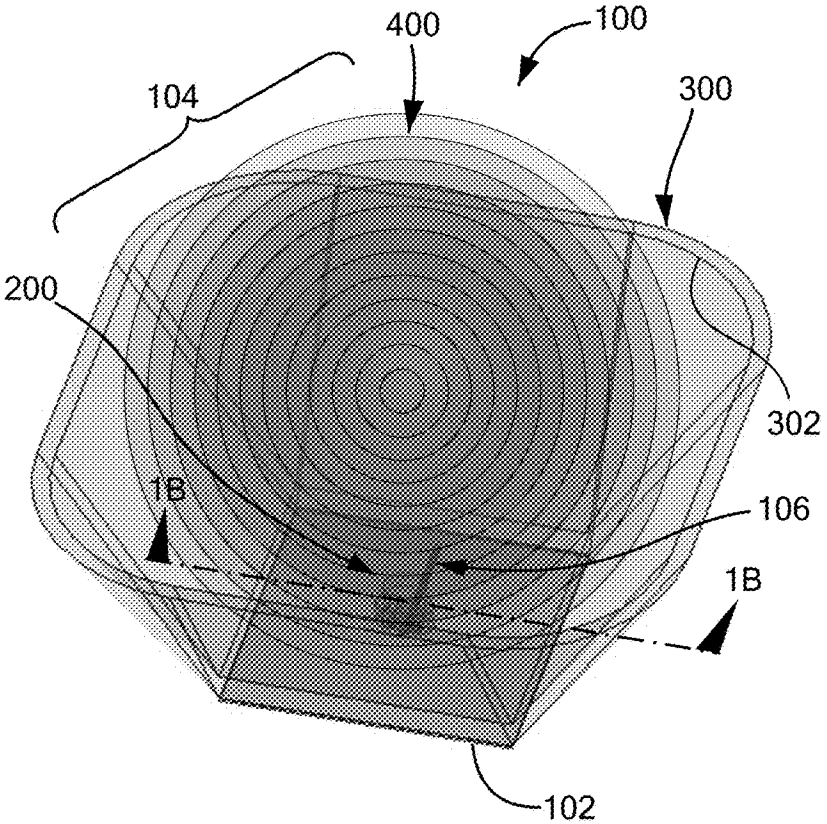
FIG. 1A depicts a rotated isometric view of an example electromagnetic device useful for building a high gain DRA system having both an electromagnetic horn and a spherical lens, in accordance with an embodiment.

With reference now to FIGS. 1A and 1B, an embodiment of an electromagnetic device 100 includes: an electrically conductive ground structure 102; at least one DRA 200 disposed on the ground structure 102; at least one EM beam shaper 104 disposed proximate a corresponding one of the DRA 200; and at least one signal feed 106 disposed electromagnetically coupled to a corresponding one of the DRA 200 to electromagnetically excite the corresponding DRA 200.

In general, excitation of a given DRA 200 is provided by a signal feed, such as a copper wire, a coaxial cable, a microstrip with slotted aperture, a waveguide, a surface integrated waveguide, or a conductive ink, for example, that is electromagnetically coupled to a particular volume of the dielectric material of the DRA 200. As will be appreciated by one skilled in the art, the phrase electromagnetically coupled is a term of art that refers to an intentional transfer of electromagnetic energy from one location to another without necessarily involving physical contact between the two locations, and in reference to an embodiment disclosed herein more particularly refers to an interaction between a signal source having an electromagnetic resonant frequency that coincides with an electromagnetic resonant mode of the associated DRA. In those signal feeds that are directly embedded in the DRA, the signal feed passes through the ground structure, in non-electrical contact with the ground structure, via an opening in the ground structure into a volume of dielectric material. As used herein, reference to dielectric materials other than non-gaseous dielectric materials includes air, which has a relative permittivity (Er) of approximately one at standard atmospheric pressure (1 atmosphere) and temperature (20 degree Celsius). As used herein, the term "relative permittivity" may be abbreviated to just "permittivity" or may be used interchangeably with the term "dielectric constant." Regardless of the term used, one skilled in the art would readily appreciate the scope of the invention disclosed herein from a reading of the entire inventive disclosure provided herein.

Figure 1C:
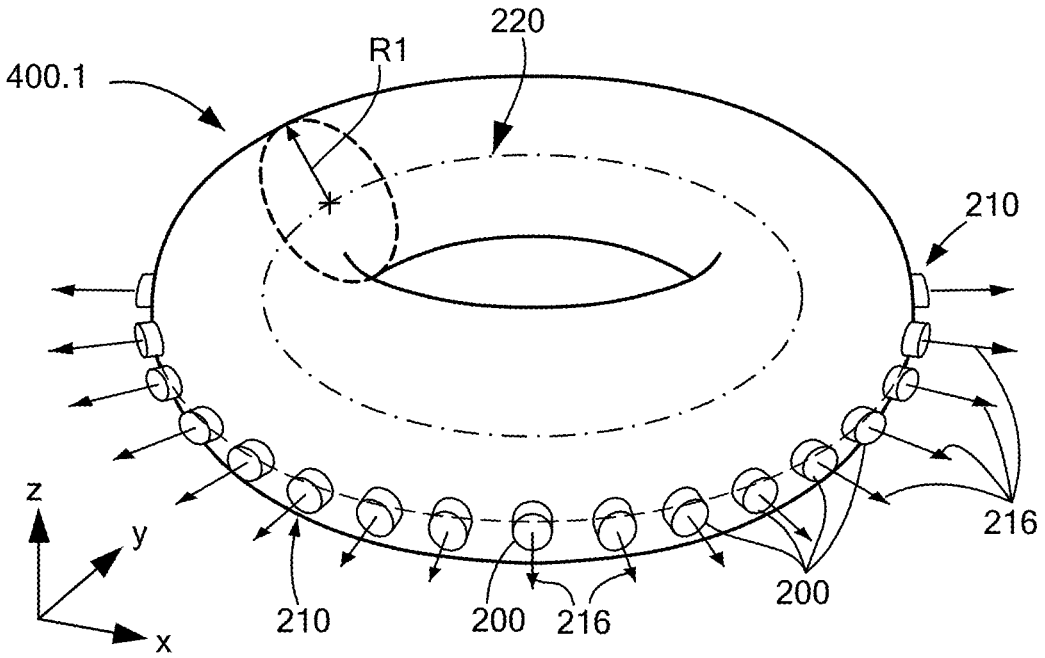
FIGS. 1C, 1D, 1E, and 1F, each depict a rotated isometric view of an example body of dielectric material having a shape other than a spherical shape, in accordance with an embodiment.
Figure 1D:
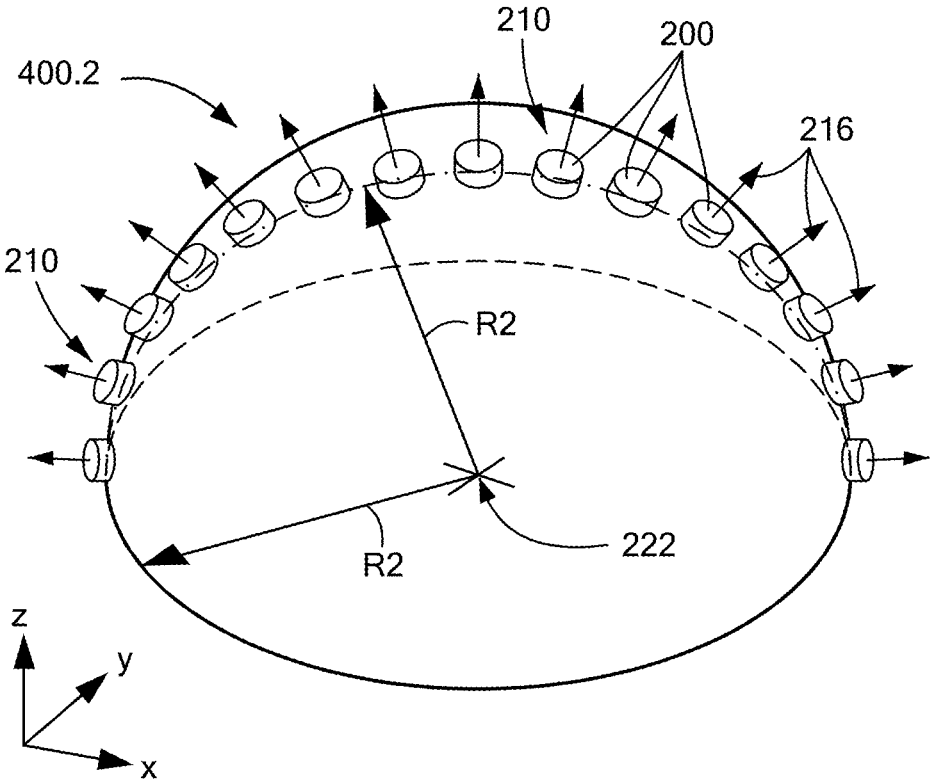
Figure 1E:
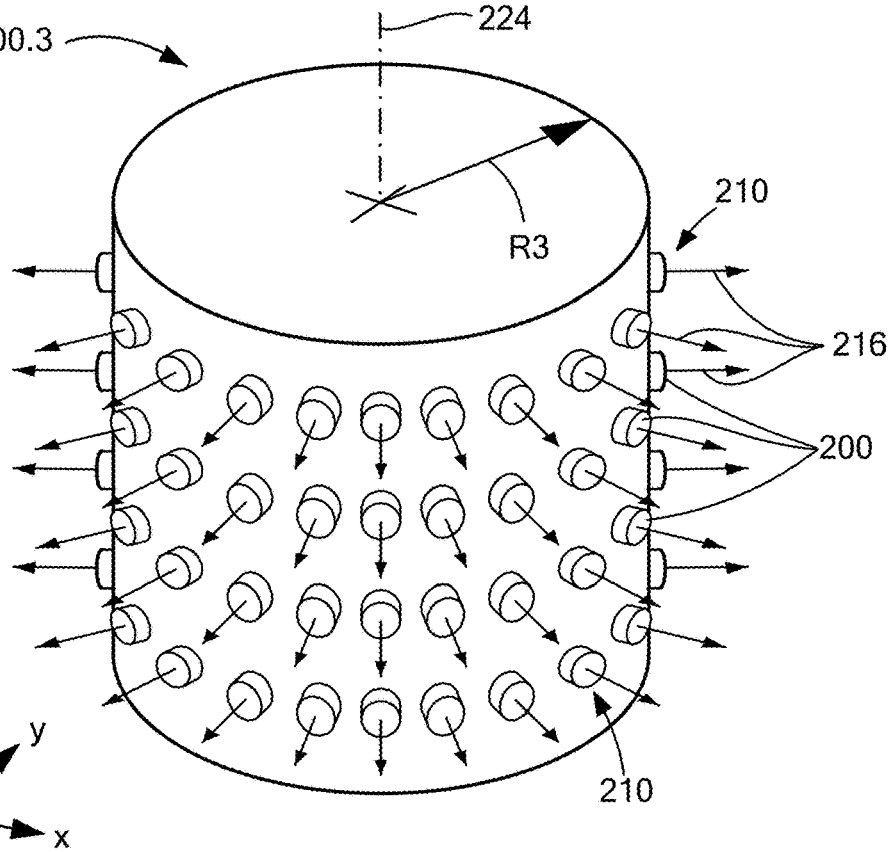
Figure 1F:
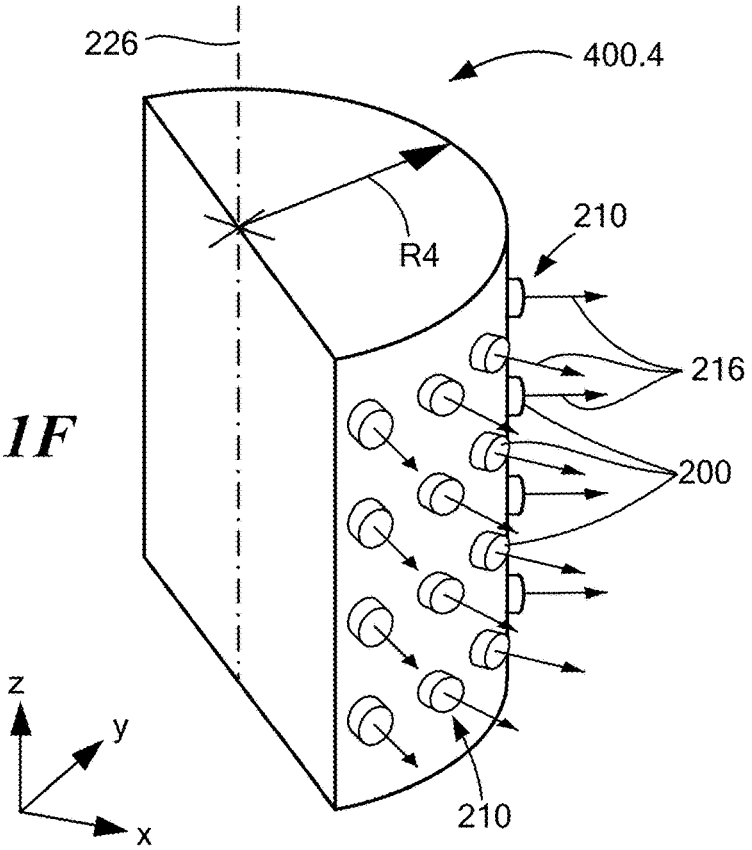

In an embodiment, the at least one EM beam shaper 104 comprises: an electrically conductive horn 300; a body of dielectric material 400 (also herein referred to as a dielectric lens, or simply a lens) having a dielectric constant that varies from an inner portion of the body to an outer surface of the body; or, both the electrically conductive horn 300 and the body of dielectric material 400. In an embodiment, the body of dielectric material 400 is a sphere, where the dielectric constant of the sphere varies from the center of the sphere to the outer surface of the sphere. In an embodiment, the dielectric constant of the sphere varies proportional to 1/R, where R is the outer radius of the sphere relative to a center of the sphere 218 (defining a spherical radius R). While embodiments depicted in the several figures provided herewith illustrate a sphere of dielectric material 400 as a planar construct, it will be appreciated that such illustration is merely due to a drafting limitation and in no way is intended to limit the scope of the invention, which in an embodiment is directed to a three dimensional body, sphere for example, of dielectric material 400. Furthermore, it will be appreciated that the body of dielectric material 400 may be any other three dimensional shape suitable for a purpose disclosed herein, such as but not limited to: a toroidal shape 400.1 for example (see FIG. 1C for example), where the dielectric constant of the three dimensional shape varies proportional to 1/R1, where R1 is the outer radius of the example toroidal shape relative to a central circular ring 220 of the example toroidal shape (defining a toroidal radius R1); a hemispherical shape 400.2 (see FIG. 1D for example), where the dielectric constant of the three dimensional shape varies proportional to 1/R2, where R2 is the outer radius of the example hemispherical shape relative to a center 222 of a planar cross sectional surface of the example hemispherical shape (defining a hemispherical radius R2); a cylindrical shape 400.3 (see FIG. 1E for example), where the dielectric constant of the three dimensional shape varies proportional to 1/R3, where R3 is the outer radius of the example cylindrical shape relative to a central axis 224 of the cylindrical shape (defining a cylindrical radius R3); or, a hemicylindrical shape 400.4 (see FIG. 1F for example), where the dielectric constant of the three dimensional shape varies proportional to 1/R4, where R4 is the outer radius of the example hemicylindrical shape relative to an axial center 226 of a planar surface of the example hemicylindrical shape (defining a hemicylindrical radius R4). While FIGS. 1C and 1D depict a single row of DRAs 200 to form an array of DRAs 210, and FIGS. 1E and 1F depict multiple rows of DRAs 200 to form an array of DRAs 210, it will be appreciated that this is for illustration purposes only, and that a scope of the invention encompasses any size array of DRAs 200 consistent with the disclosure herein. Other embodiments for the three dimensional shape of the dielectric material may include: an elliptical shape (referred to with reference to the dielectric material 400 of FIG. 1B being elongated with respect to the x, y, or z, axis; or, a hemielliptical shape (referred to by reference to the dielectric material 400.2 of FIG. 1D being elongated with respect to the x, y, or z, axis). As such, while some embodiments depicted and described herein refer to the body of dielectric material specifically being a sphere, it will be appreciated that this is for illustrative purposes only and that the body of dielectric material may be any three dimensional body suitable for a purpose disclosed herein. As will be appreciated by one skilled in the art, by providing alternative shapes for the body of dielectric material 400, alternative far field radiation patterns and/or directions may be achieved.

In an embodiment and with reference particularly to FIGS. 2A, 2B, 2C, 2D and 2E, the at least one DRA 200 (individually denoted in FIGS. 2A-2E by reference numerals 200A, 200B, 200C, 200D and 200E, respectively) comprises at least one of: a multi-layered DRA 200A comprising two or more dielectric materials 200A.1, 200A.2, 200A.3 with different dielectric constants and where at least two of the dielectric materials 200A.2 and 200A.3 are non-gaseous dielectric materials; a single-layered DRA 200B having a hollow core 200B.1 enveloped by a single layer of non-gaseous dielectric material 200B.2; a DRA 200A, 200B having a convex top 202A, 202B; a DRA 200C comprising a plan view cross section having a geometric form 206C other than a rectangle; a DRA 200C, 200D comprising a plan view cross section having a geometric form 206C, 206D of a circle, an oval, an ovaloid, an ellipse, or an ellipsoid; a DRA 200A, 200B comprising an elevation view cross section having a geometric form 208A, 208B other than a rectangle; a DRA 200A comprising an elevation view cross section having vertical side walls 204A and a convex top 202A; or, a DRA 200E having an overall height Hv and an overall width Wv where the overall height Hv is greater than the overall width Wv.

Figure 2B:
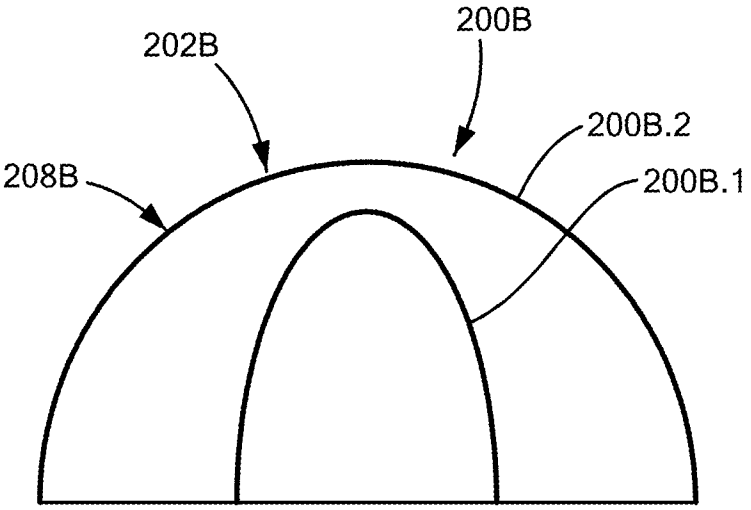
FIGS. 2A, 2B, 2C, 2D and 2E, depict, respectively, an elevation view cross section, an elevation view cross section, a plan view cross section, a plan view cross section, and an elevation view cross section, of alternative embodiments of a DRA suitable for a purpose disclosed herein, in accordance with an embodiment.
Figure 2A:
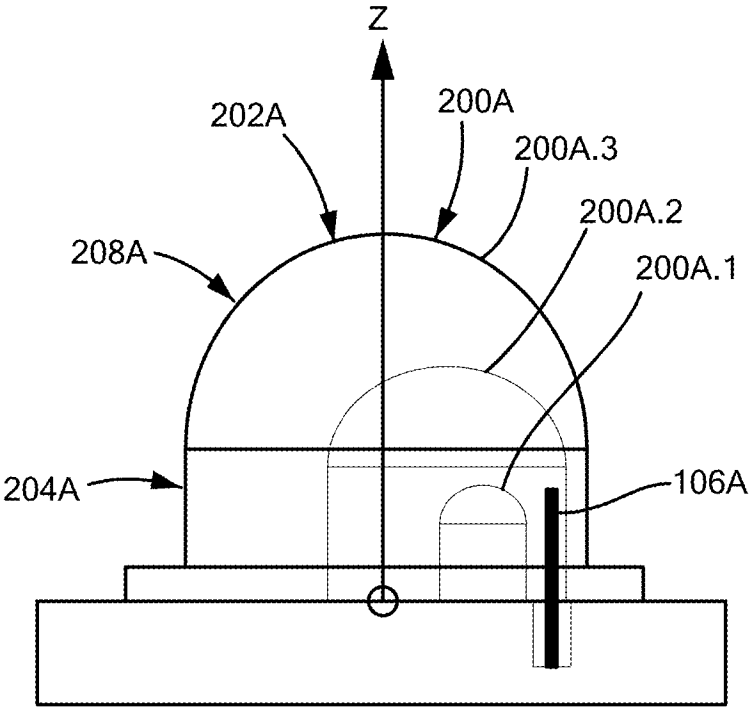

In an embodiment and with reference particularly to FIG. 2A, DRA 200A comprises a plurality of volumes of dielectric materials 200A.1, 200A.2, 200A.3 comprising N volumes (N=3 in FIG. 2A), N being an integer equal to or greater than 3, disposed to form successive and sequential layered volumes V(i), i being an integer from 1 to N, wherein volume V(1) 200A.1 forms an innermost first volume, wherein a successive volume V(i+1) forms a layered shell disposed over and at least partially embedding volume V(i), wherein volume V(N) 200A.3 at least partially embeds all volumes V(1) to V(N−1), and wherein a corresponding signal feed 106A is disposed electromagnetically coupled to one of the plurality of volumes of dielectric materials 200A.2. In an embodiment, the innermost first volume V(1) 200A.1 comprises a gaseous dielectric medium (i.e., the DRA 200A has a hollow core 200A.1).

Figure 2D:
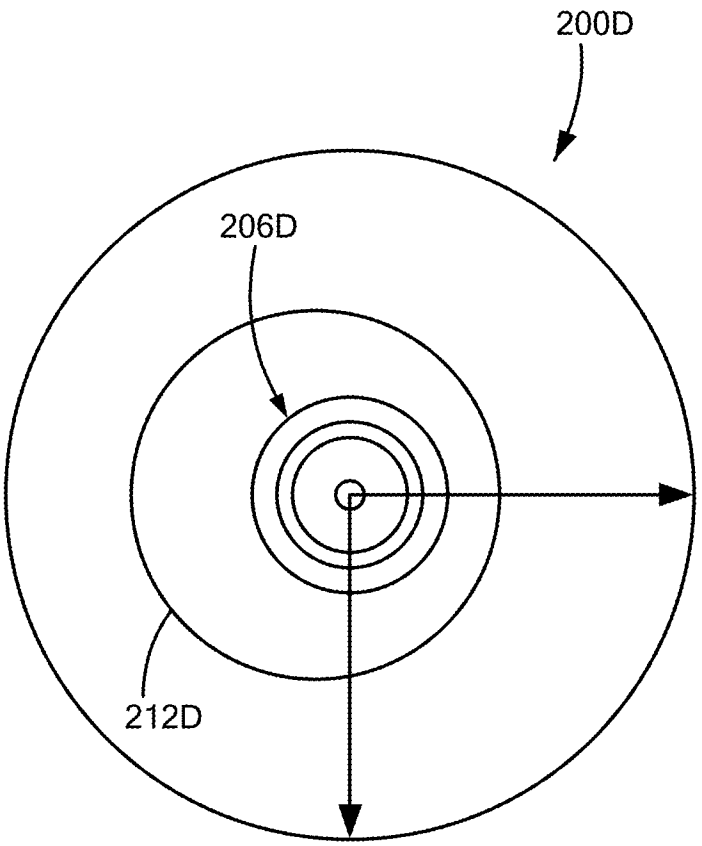
Figure 2C:
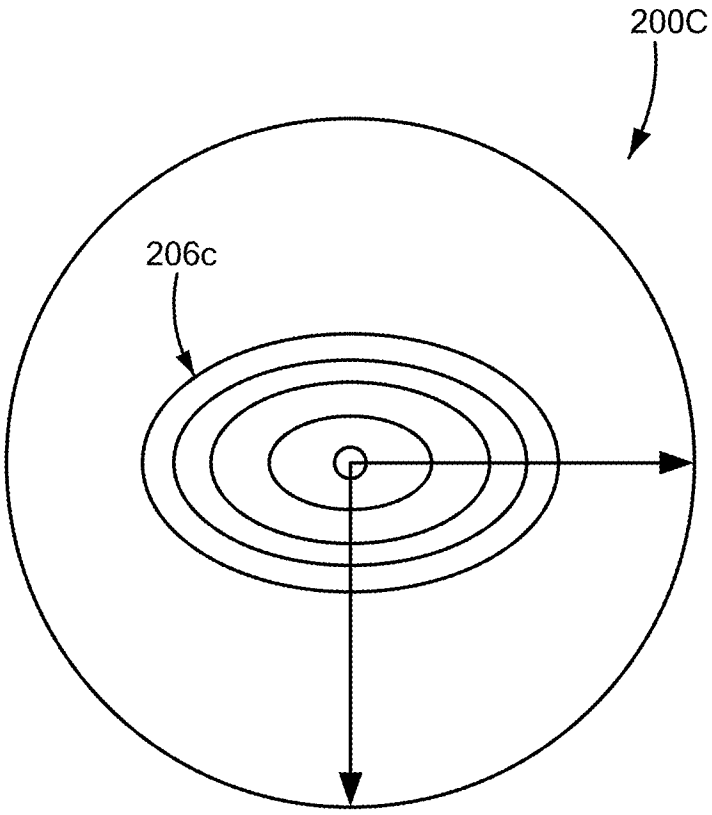
Figure 2E:
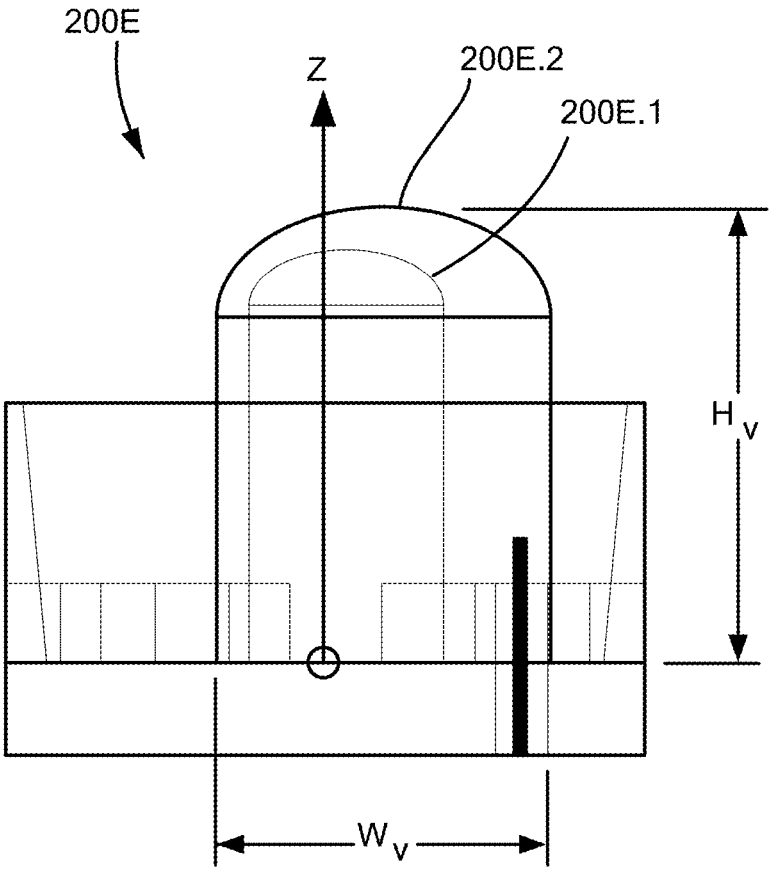

In an embodiment and with reference particularly to FIG. 2E, DRA 200E comprises a volume comprising non-gaseous dielectric material 200E.2, the volume having a hollow core 200E.1, a cross sectional overall maximum height Hv as observed in an elevation view, and a cross sectional overall maximum width Wv as observed in a plan view (as seen in FIG. 2E in the elevation view), wherein the volume is a volume of a single dielectric material composition, and wherein Hv is greater than Wv. In an embodiment, the hollow core 200E.1 comprises air.

It will be appreciated from the foregoing description relating to FIGS. 2A-2F that embodiments of any DRA 200 suitable for a purpose disclosed herein may have any combination of the structural attributes depicted in FIGS. 2A-2F, such as a single-layer or a multi-layer DRA with or without a hollow core where the cross sectional overall maximum height Hv of the DRA is greater than the cross sectional overall maximum width Wv of the corresponding DRA. Also, and with reference to FIGS. 2A, 2C and 2D, embodiments of any DRA 200 suitable for a purpose disclosed herein may have individual volumes of dielectric materials sideways shifted with respect to each other as depicted in FIG. 2A, may have individual volumes of dielectric materials centrally disposed with respect to each other as depicted in FIG. 2C, or may have a series of inner ones of individual volumes of dielectric materials 206D centrally disposed with respect to each other and an enveloping volume 212D of dielectric material sideways shifted with respect to the series of inner volumes as depicted in FIG. 2D. Any and all such combinations of structural attributes disclosed individually herein but not necessarily disclosed in certain combinations in a given DRA are contemplated and considered to be within the scope of the invention disclosed herein.

Figure 3B:
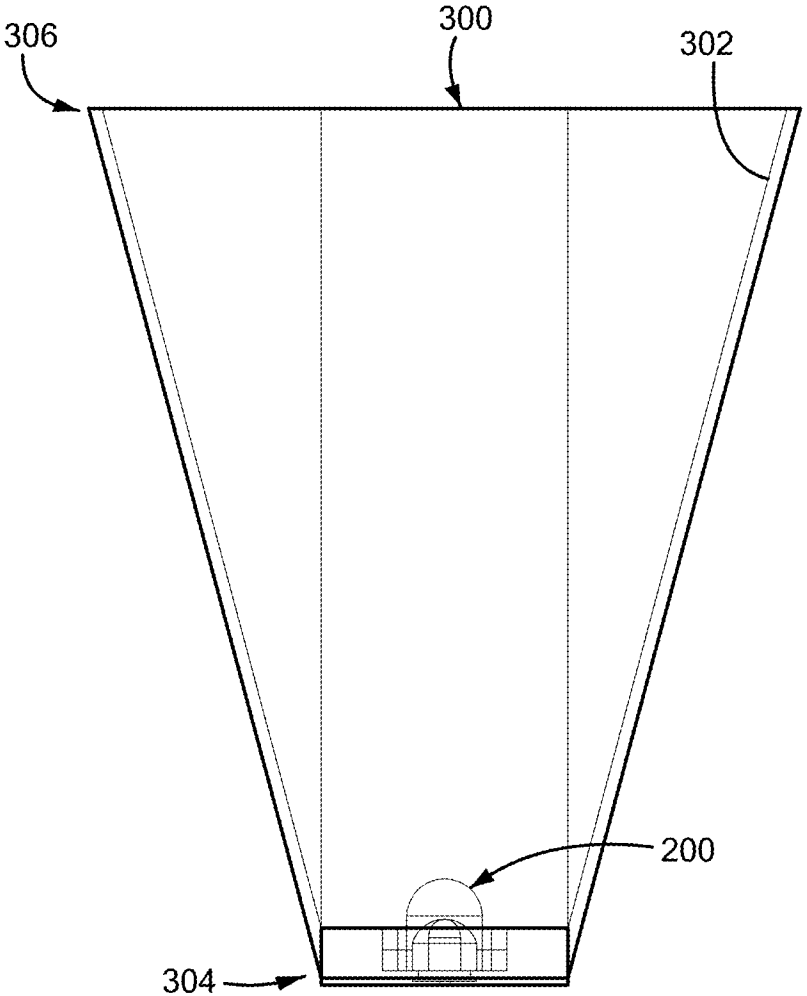
FIG. 3B depicts an elevation view cross section through section line 3B-3B of the electromagnetic device of FIG. 3A, in accordance with an embodiment.
Figure 3A:
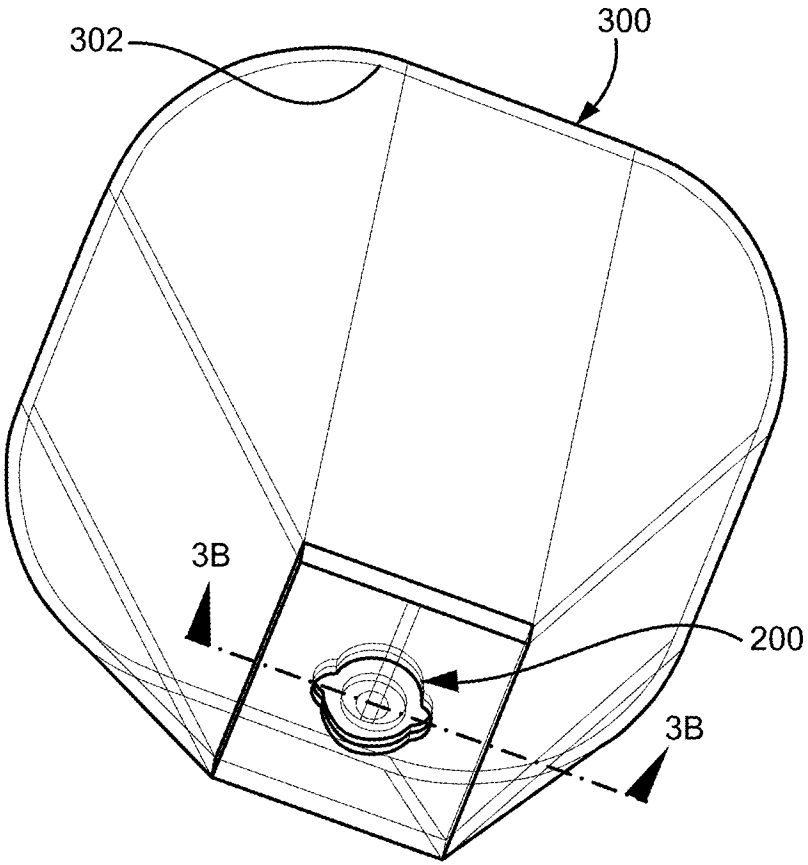
FIG. 3A depicts a rotated isometric view of an example electromagnetic device useful for building a high gain DRA system having an electromagnetic horn absent a spherical lens, in accordance with an embodiment.

With reference to FIGS. 3A and 3B in combination with FIGS. 1A and 1B, in an embodiment where the EM beam shaper 104 comprises an electrically conductive horn 300, the electrically conductive horn 300 may comprise side walls 302 that diverge outwards from a first proximal end 304 to a second distal end 306, the first proximal end 304 being disposed in electrical contact with the ground structure 102, the second distal end 306 being disposed at a distance from the associated at least one DRA 200, and the side walls 302 being disposed surrounding or substantially surrounding the associated at least one DRA 200. In an embodiment, and with reference particularly to FIG. 1B, the length Lh of the electrically conductive horn 300 is less than the diameter Ds of the sphere of dielectric material 400. In an embodiment, the distal end 306 of the electrically conductive horn 300 has an aperture 308 that is equal to or greater than the diameter Ds of the sphere of dielectric material 400. More generally, the distal end 306 of the electrically conductive horn 300 has an aperture 308 that is equal to or greater than the overall outside dimension of the body of dielectric material 400.

Figure 4:
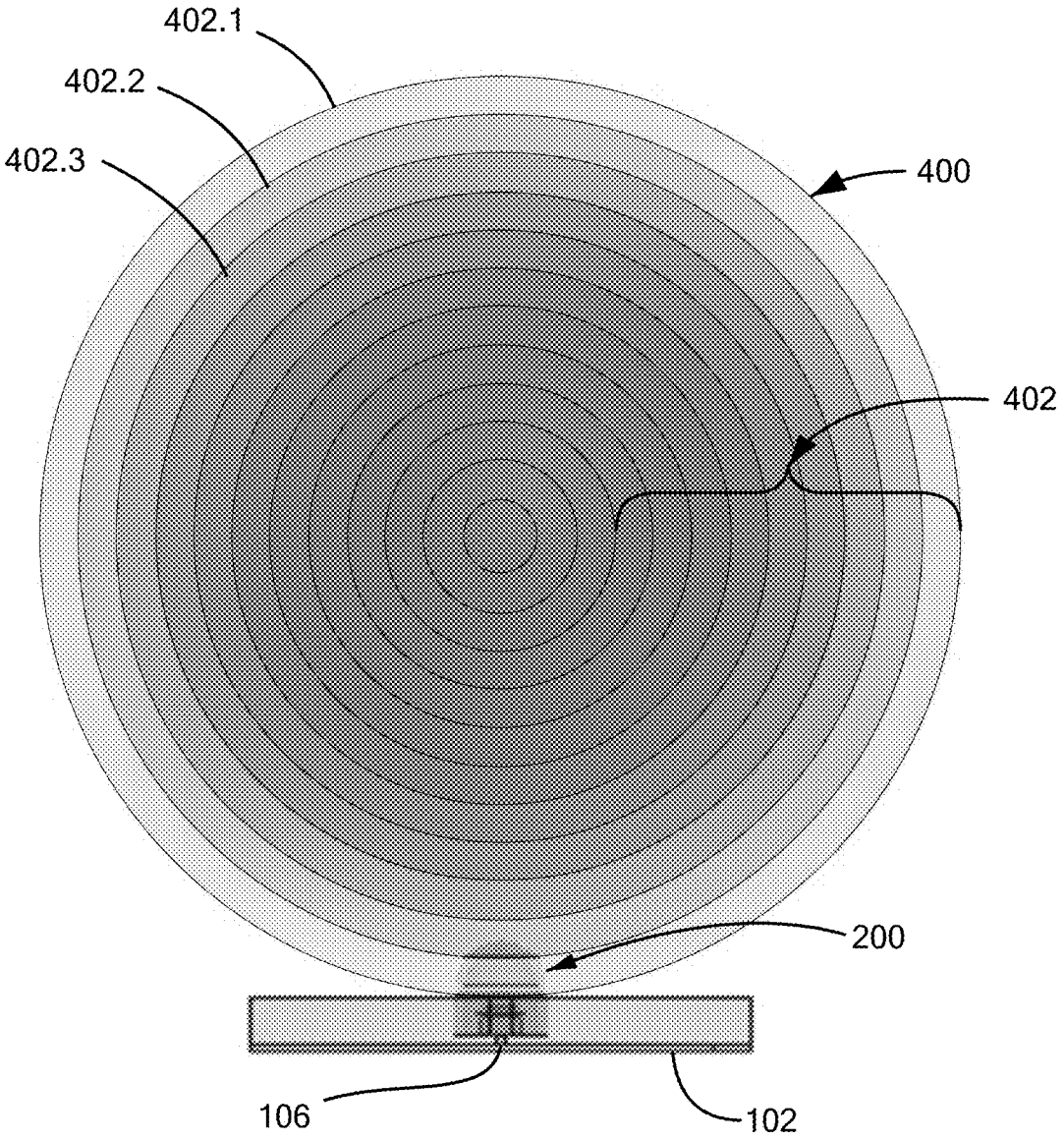
FIG. 4 depicts an elevation view cross section of an example electromagnetic device useful for building a high gain DRA system having a spherical lens absent an electromagnetic horn where the DRA is at least partially embedded in the spherical lens, in accordance with an embodiment.

With reference to FIG. 1B and FIG. 4, in an embodiment where the EM beam shaper 104 comprises a sphere of dielectric material 400, the sphere of dielectric material 400 has a dielectric constant that decreases from the center of the sphere to the surface of the sphere. For example, the dielectric constant at the center of the sphere may be 2, 3, 4, 5, or any other value suitable for a purpose disclosed herein, and the dielectric constant at the surface of the sphere may be 1, substantially equal to the dielectric constant of air, or any other value suitable for a purpose disclosed herein. In an embodiment, the sphere of dielectric material 400 comprises a plurality of layers of dielectric materials, depicted and denoted in FIG. 1B and FIG. 4 as concentric rings 402 disposed around a central inner sphere, having different dielectric constants that decrease successively from the center of the sphere to the surface of the sphere. For example, the number of layers of dielectric materials may be 2, 3, 4, 5, or any other number suitable for a purpose disclosed herein. In an embodiment, the sphere of dielectric material 400 has a dielectric constant of 1 at the surface of the sphere. In an embodiment, the sphere of dielectric material 400 has a varying dielectric constant from the center of the sphere to the outer surface of the sphere that varies according to a defined function. In an embodiment, the diameter of the sphere of dielectric material 400 is equal to or less than 20 millimeters (mm). Alternatively, the diameter of the sphere of dielectric material 400 may be greater than 20 mm, as the collimation of the far field radiation pattern increases as the diameter of the sphere of dielectric material 400 increases.

With reference particularly to FIG. 4, in an embodiment where the EM beam shaper 104 comprises a sphere of dielectric material 400, each DRA 200 may be at least partially embedded in the sphere of dielectric material 400, which is depicted in FIG. 4 where the DRA 200 is embedded in the first and second layers 402.1, 402.2, but not in the third layer 402.3.

Figure 5A:
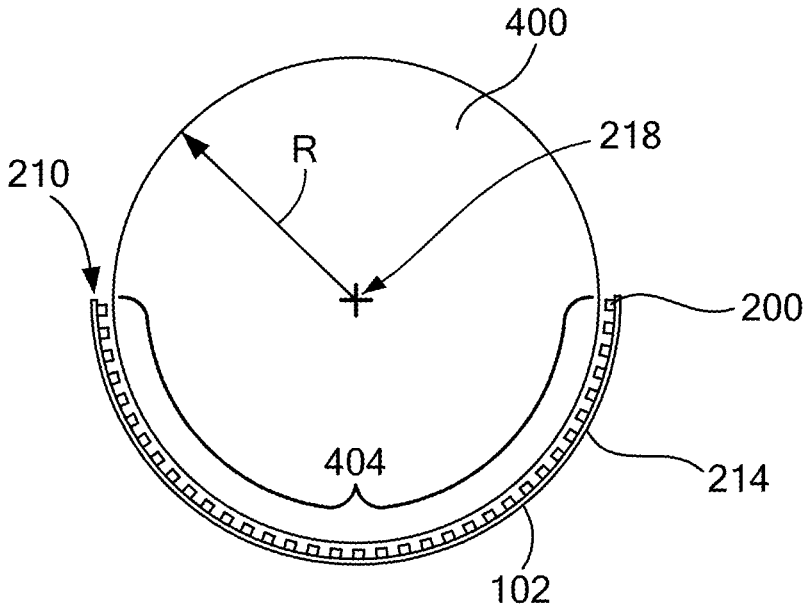
FIG. 5A depicts an elevation view cross section of an example electromagnetic device useful for building a high gain DRA system having an array of DRAs disposed in a non-planar arrangement at least partially around the surface of a spherical lens, in accordance with an embodiment.

With reference now to FIG. 5A, in an embodiment where the EM beam shaper 104 comprises a sphere of dielectric material 400 and the at least one DRA 200 comprises an array of the at least one DRA 200 to form an array of DRAs 210, the array of DRAs 210 may be disposed on a non-planar substrate 214 and disposed at least partially around the outer surface 404 of the sphere of dielectric material 400, and where as previously noted the sphere of dielectric material may more generally be a body of dielectric material. In an embodiment, the non-planar substrate 214 is integrally formed with the ground structure 102. In an embodiment, the at least one DRA 200 may be disposed on a curved or flexible substrate, such as a flexible printed circuit board for example, and may be arranged integral with the lens 400, which may be a Luneburg lens for example. In view of FIG. 5A, it will be appreciated that an embodiment includes an array of DRAs 210 that are disposed at least partially around the outer surface of the body of dielectric material 400 in a concave arrangement.

Figure 6:
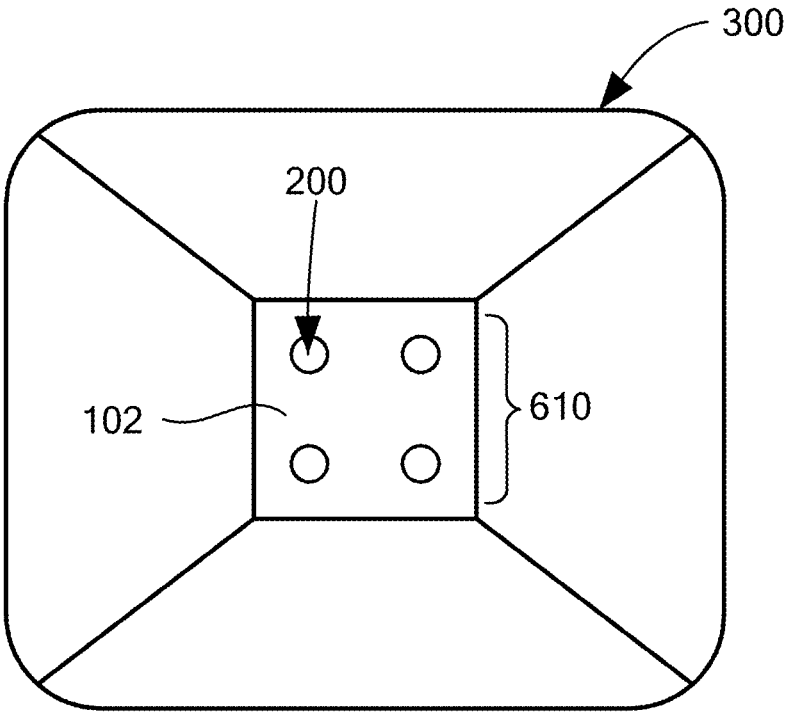
FIG. 6 depicts a plan view cross section of an example electromagnetic device useful for building a high gain DRA system having an array of DRAs disposed within an electromagnetic horn, in accordance with an embodiment.

While FIG. 5A depicts a one-dimensional array of DRAs 210 associated with a sphere of dielectric material 400, it will be appreciated that the scope of the invention is not so limited and also encompasses a two-dimensional array of DRAs, which may be associated with a sphere of dielectric material 400, or with an electrically conductive horn 300. For example and with reference to FIG. 6, in an embodiment where the EM beam shaper 104 comprises an electrically conductive horn 300 and the at least one DRA 200 comprises an array of the at least one DRA 200 to form an array of DRAs 610, the array of DRAs 610 may be disposed within the electrically conductive horn 300 on the ground structure 102. Alternatively and while not explicitly illustrated, it will be appreciated that a two-dimensional array of DRAs may be disposed on the non-planar substrate 214 and arranged integral with the lens 400. That is, the array of DRAs 210 depicted in FIG. 5A is representative of both a one-dimensional array of DRAs and a two-dimensional array of DRAs.

Figure 5B:
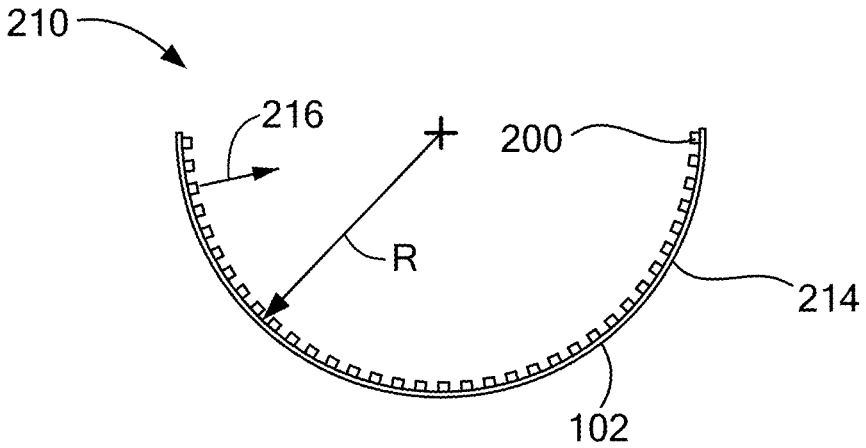
FIG. 5B depicts an elevation view cross section of an example electromagnetic device useful for building a high gain DRA system having an array of DRAs disposed on a concave curvature of a non-planar substrate, in accordance with an embodiment.
Figure 5C:
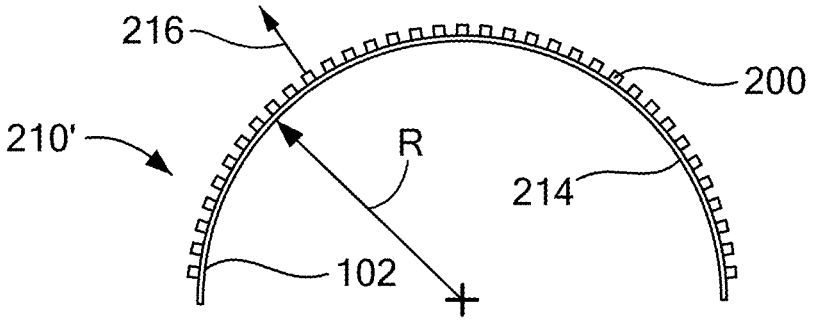
FIG. 5C depicts an elevation view cross section of an example electromagnetic device useful for building a high gain DRA system having an array of DRAs disposed on a convex curvature of a non-planar substrate, in accordance with an embodiment.

With reference now to FIGS. 5B and 5C as compared with FIG. 5A, it will be appreciated that an embodiment includes an array of DRAs 210, 210' where the DRAs 200 are disposed on the ground structure 102, and the ground structure 102 is disposed on a non-planar substrate 214, absent the foregoing described body or sphere of dielectric material 400. In an embodiment, the array of DRAs 210 are disposed on a concave curvature of the non-planar substrate 214 (best seen with reference to FIG. 5B), absent the foregoing described body or sphere of dielectric material 400. In an embodiment, the array of DRAs 210' are disposed on a convex curvature of the non-planar substrate 214 (best seen with reference to FIG. 5C), absent the foregoing described body or sphere of dielectric material 400. In an antenna embodiment operating on a non-planar substrate, the individual signal feeds to the respective DRAs may be phase delayed in order to compensate for the curvature of the antenna substrate.

As noted herein above, the at least one DRA 200 may be singly fed, selectively fed, or multiply fed by one or more signal feeds 106, which in an embodiment may be any type of signal feed suitable for a purpose disclosed herein, such as a coaxial cable with a vertical wire extension, to achieve extremely broad bandwidths, or via a microstrip with slotted aperture, a waveguide, or a surface integrated waveguide, for example. The signal feed may also include a semiconductor chip feed. In an embodiment, each DRA 200 of the array of DRAs 210, 610 is separately fed by a corresponding one of the at least one signal feed 106 to provide a multi-beam antenna. Alternatively, each DRA 200 of the array of DRAs 210, 610 is selectably fed by a single signal feed 106 to provide a steerable multi-beam antenna. As used herein, the term "multi-beam" encompasses an arrangement where there is only one DRA feed, an arrangement where the DRA system may steer the beam by selecting which DRA is fed via the signal feed, and an arrangement where the DRA system may feed multiple DRAs and to produce multiple beams oriented in different directions.

While embodiments may be described herein as being transmitter antenna systems, it will be appreciated that the scope of the invention is not so limited and also encompasses receiver antenna systems.

Embodiments of the DRA arrays disclosed herein are configured to be operational at an operating frequency (f) and associated wavelength ($\lambda$). In some embodiments the center-to-center spacing (via the overall geometry of a given DRA) between closest adjacent pairs of the plurality of DRAs within a given DRA array may be equal to or less than $\lambda$, where $\lambda$ is the operating wavelength of the DRA array in free space. In some embodiments the center-to-center spacing between closest adjacent pairs of the plurality of DRAs within a given DRA array may be equal to or less than $\lambda$ and equal to or greater than $\lambda/2$. In some embodiments the center-to-center spacing between closest adjacent pairs of the plurality of DRAs within a given DRA array may be equal to or less than $\lambda/2$. For example, at $\lambda$ for a frequency equal to 10 GHz, the spacing from the center of one DRA to the center of a closet adjacent DRA is equal to or less than about 30 mm, or is between about 15 mm to about 30 mm, or is equal to or less than about 15 mm.

Analytical results of mathematical models of various example embodiments of an electromagnetic device 100 as disclosed herein have exhibited improved performance as compared to other such devices not employing certain structure as disclosed herein, which will now be discussed with reference to FIGS. 7A, 7B, 8A, 8B, 8C and 8D.

Figure 7A:
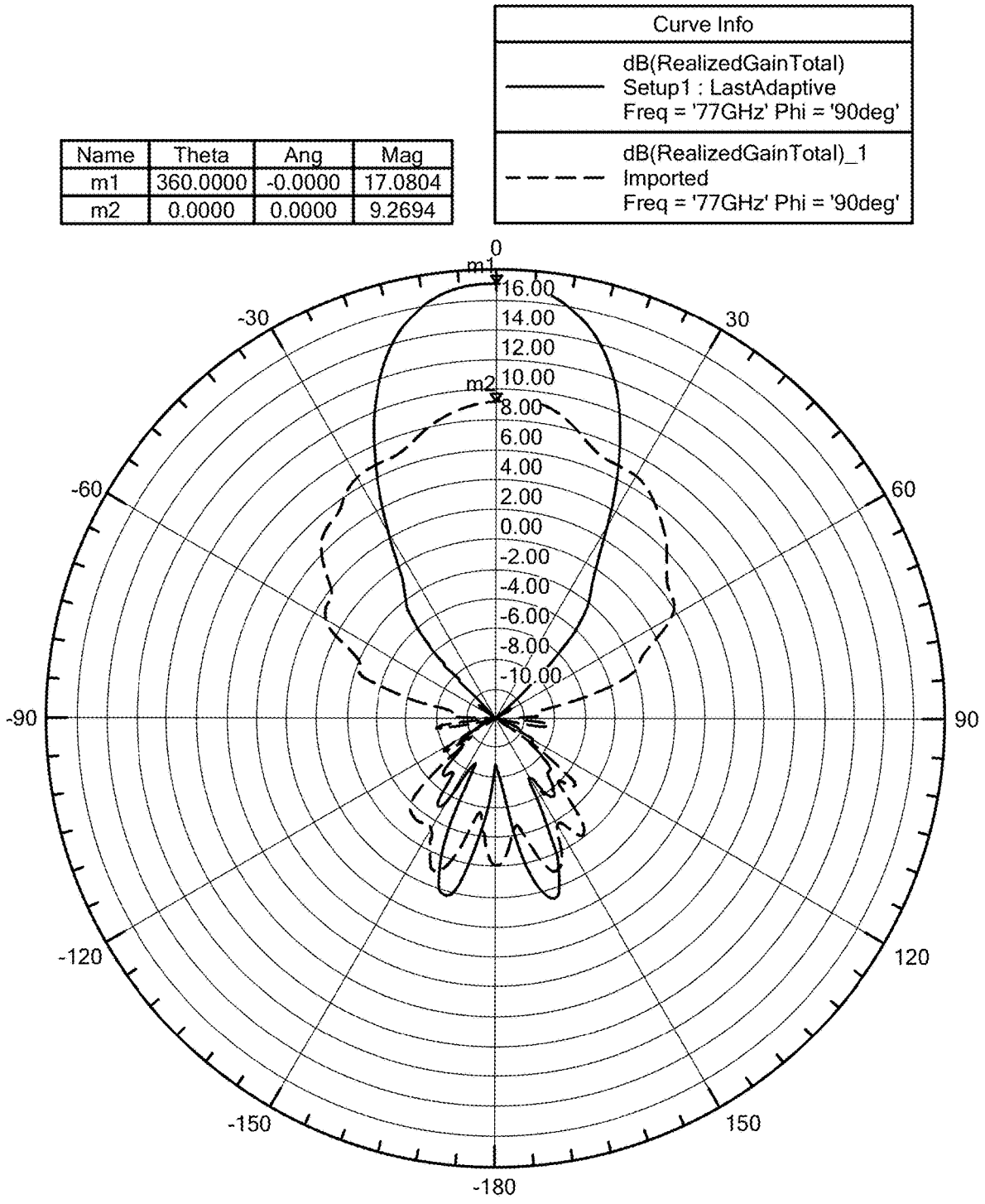
FIGS. 7A, 7B, 8A, 8B, 8C, 8D and 8E, depict analytical results of mathematical models of example embodiments disclosed herein, in accordance with an embodiment.
Figure 7B:
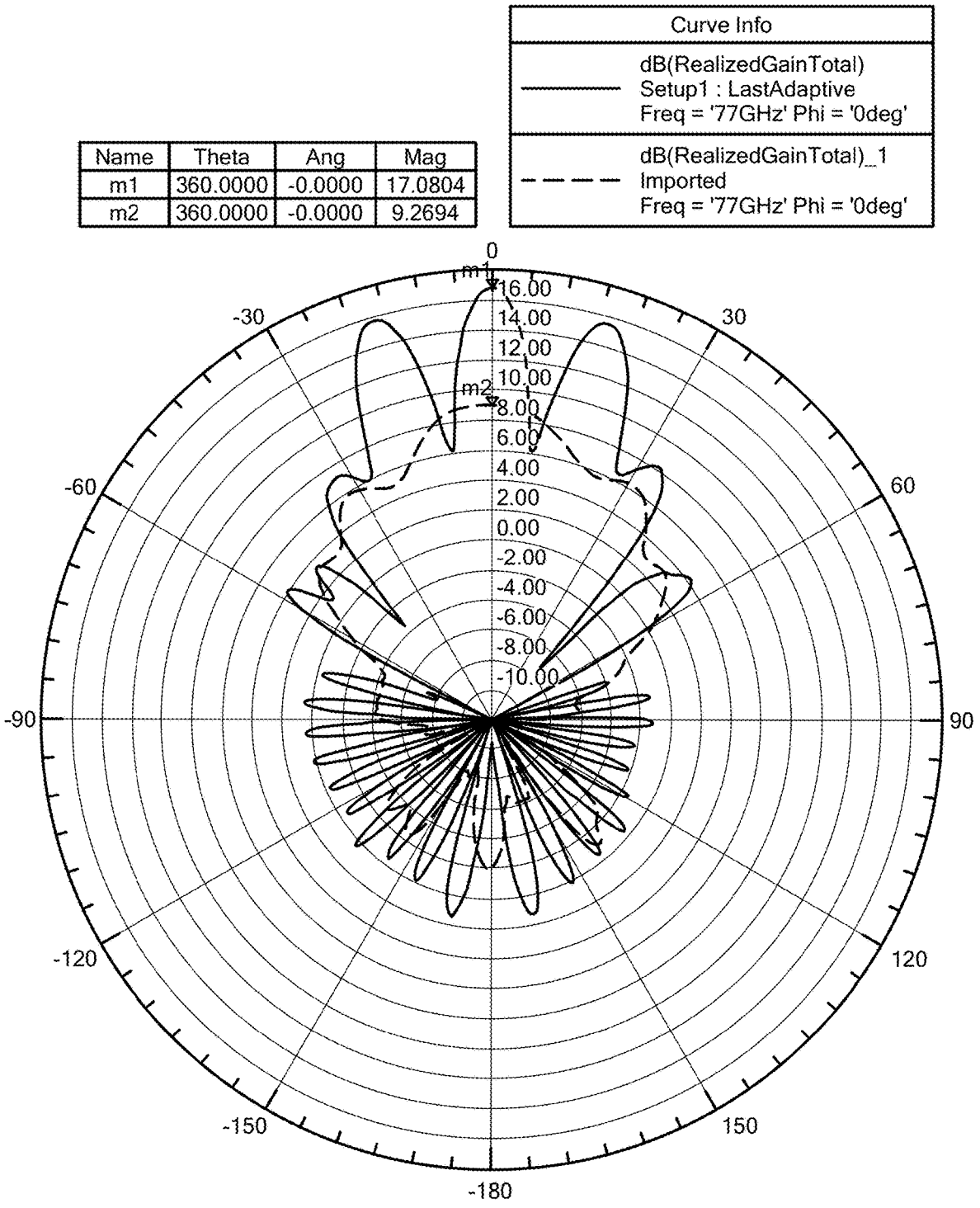

Regarding FIGS. 7A and 7B, the mathematical model analyzed here is representative of the embodiment depicted in FIGS. 3A and 3B, with and without the electrically conductive horn 300. FIGS. 7A and 7B depict realized gain total (dBi) of the far field radiation pattern in the y-z plane and the x-z plane, respectively, and compares the gain of a DRA system having an electrically conductive horn 300 (solid line plot) with the gain of a similar DRA system but absent the electrically conductive horn 300 (dashed line plot). As may be seen, the inclusion of an electrically conductive horn 300 with a DRA 200 as disclosed herein, produces analytical results that show an increase in far field gain from about 9.3 dBi to about 17.1 dBi in both the y-z plane and the x-z plane. The analytical results also exhibit a single-lobe radiation pattern in the y-z plane (FIG. 7A), while exhibiting a three-lobe radiation pattern in the x-z plane (FIG. 7B). Regarding such results, it is contemplated that use of a spherical lens as disclosed herein will not only improve the collimation of the far field radiation pattern (i.e., modify the three-lobe radiation pattern in the x-z plane to a more central single-lobe radiation pattern), but will also further improve the gain by about 6 dBi.

Regarding FIGS. 8A, 8B, 8C, 8D and 8E, the mathematical model analyzed here is representative of the embodiment depicted in FIG. 4, with and without the sphere of dielectric material 400 (e.g., dielectric lens), and absent an electrically conductive horn 300.

Figure 8A:
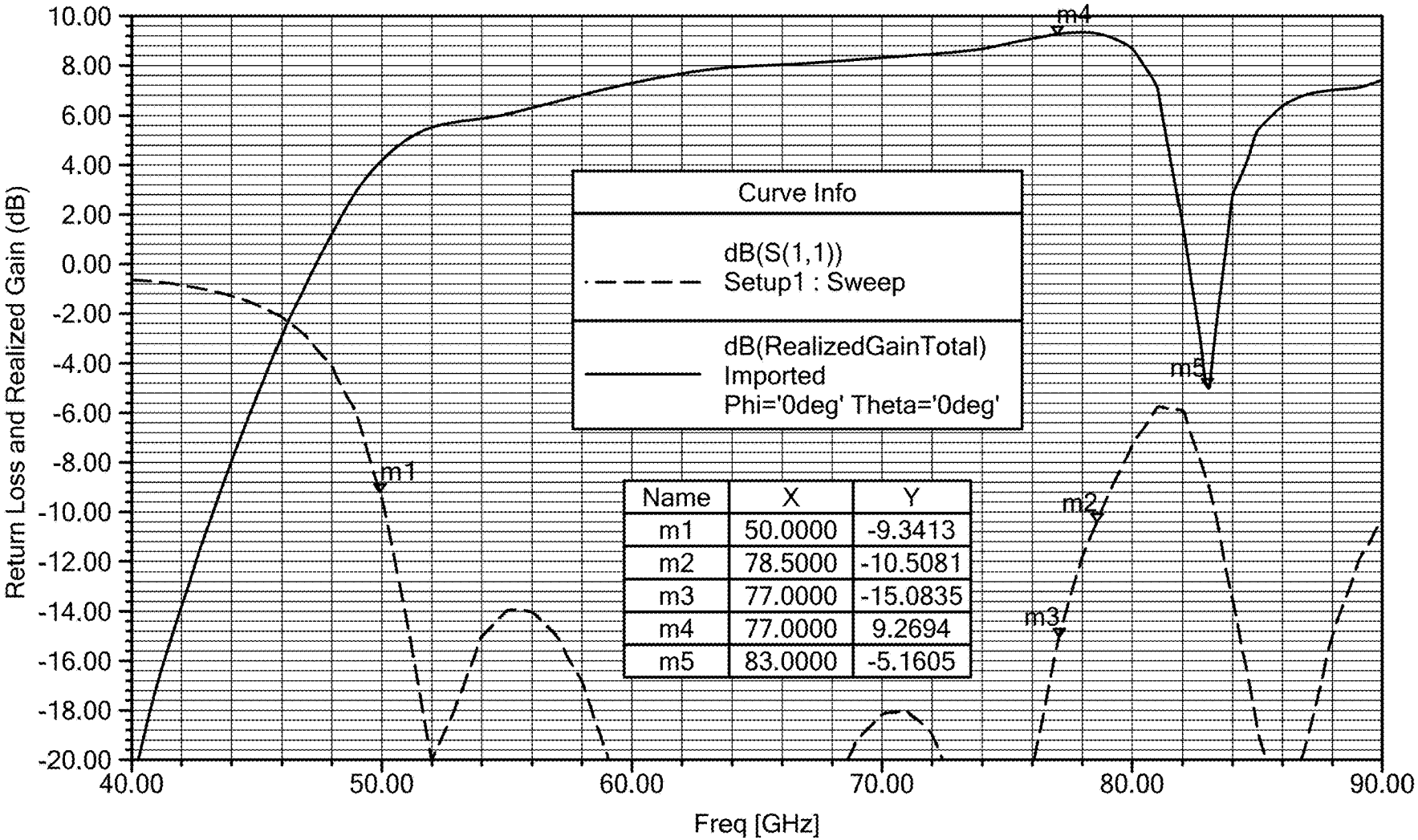

FIG. 8A depicts the return loss (dashed line plot) and realized gain total (dBi) (solid line plot) from 40 GHz to 90 GHz excitation of an embodiment of FIG. 4, but absent a dielectric lens 400 as a bench mark. As may be seen, the bench mark of realized gain total absent a dielectric lens 400 is about 9.3 dBi at 77 GHz. Markers m1, m2, m3, m4 and m5 are depicted with corresponding x (frequency) and y (gain) coordinates. TE radiating modes were found to occur between about 49 GHz and about 78 GHz. A quasi TM radiating mode was found to occur around 80 GHz.

Figure 8B:
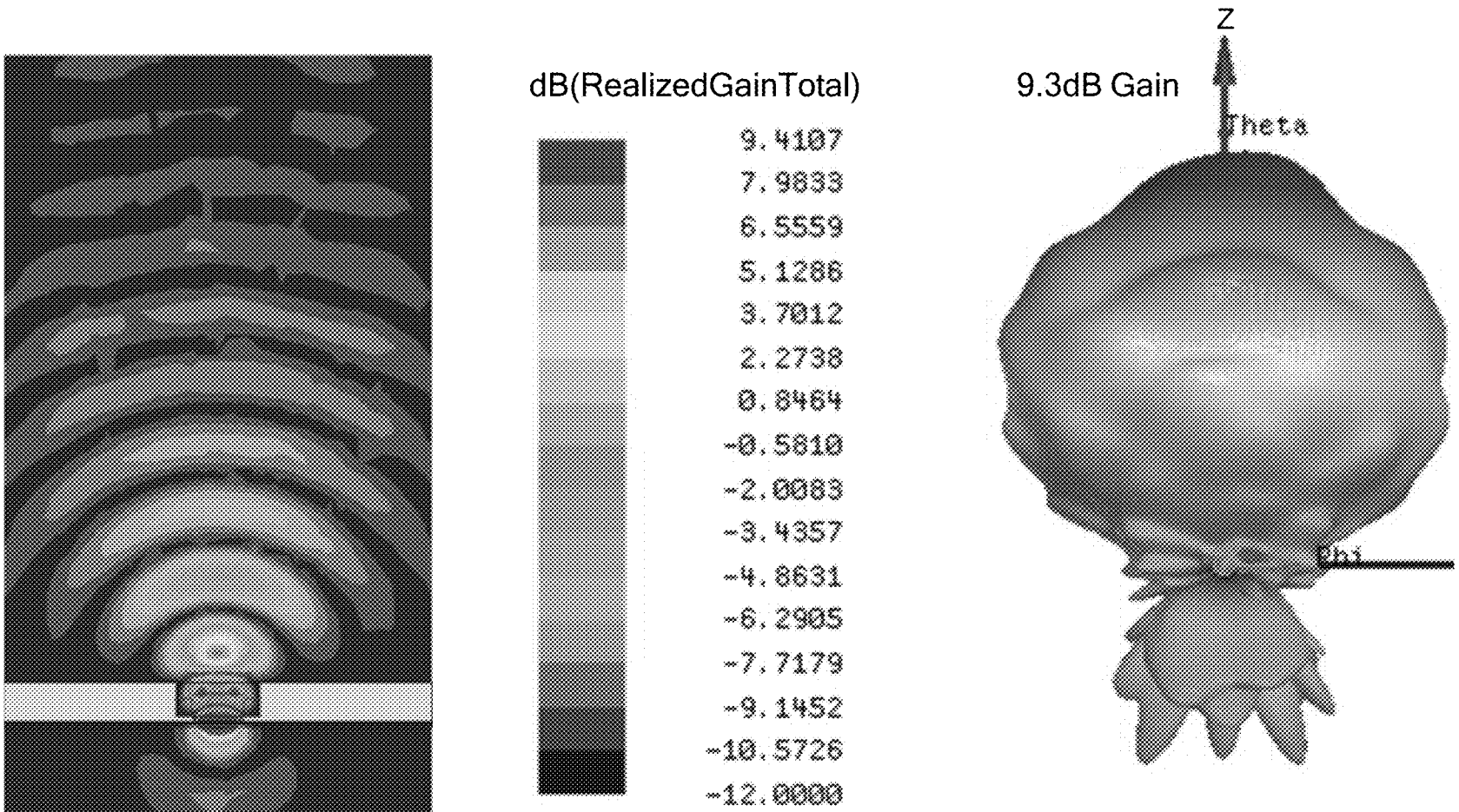
Figure 8C:
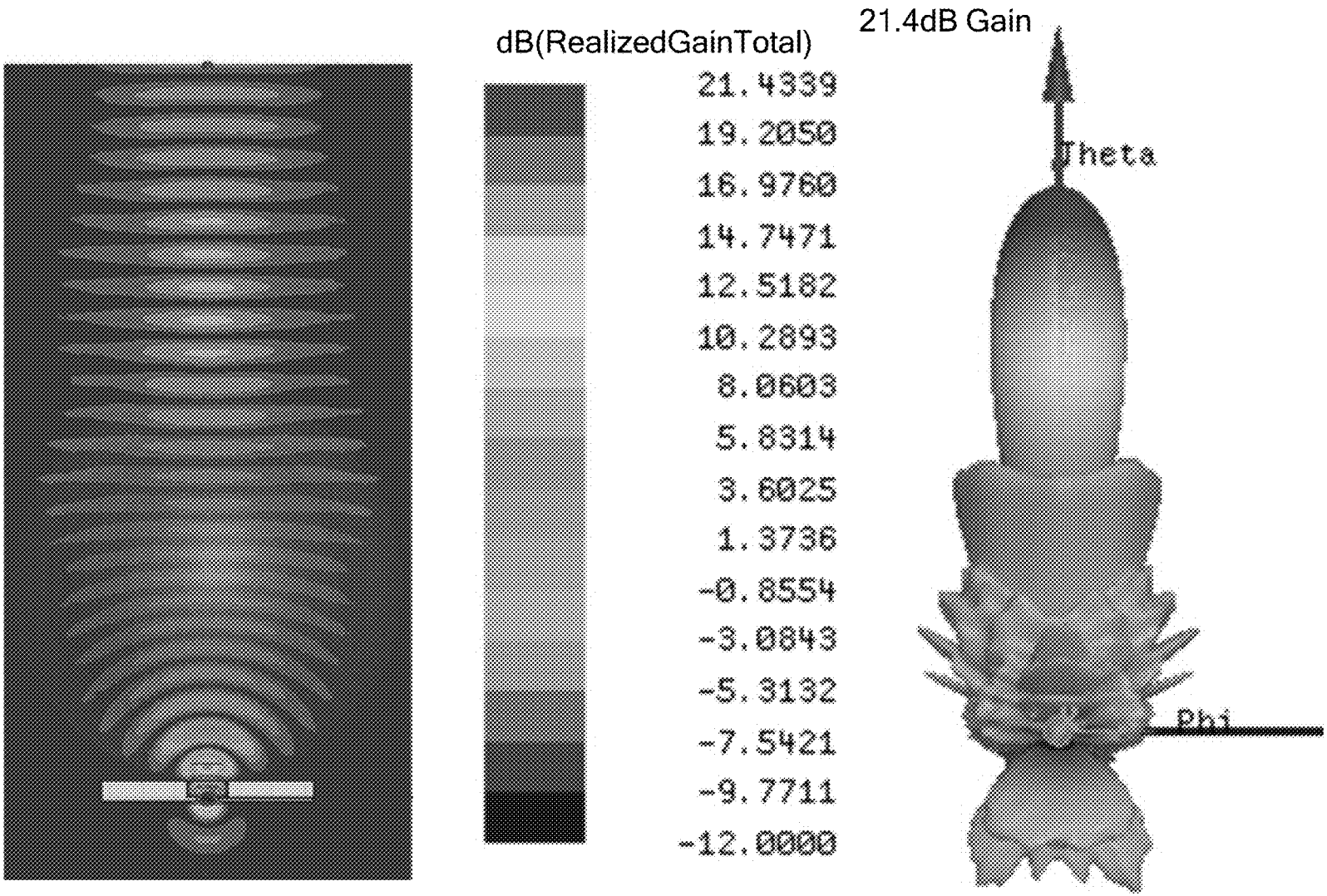

FIGS. 8B and 8C depict realized gain total (dBi) of the far field radiation pattern without a dielectric lens 400 and with a dielectric lens 400, respectively, at 77 GHz, and shows an increase of realized gain total from about 9.3 dBi to about 21.4 dBi with the inclusion of the dielectric lens 400 in the DRA system.

Figure 8D:
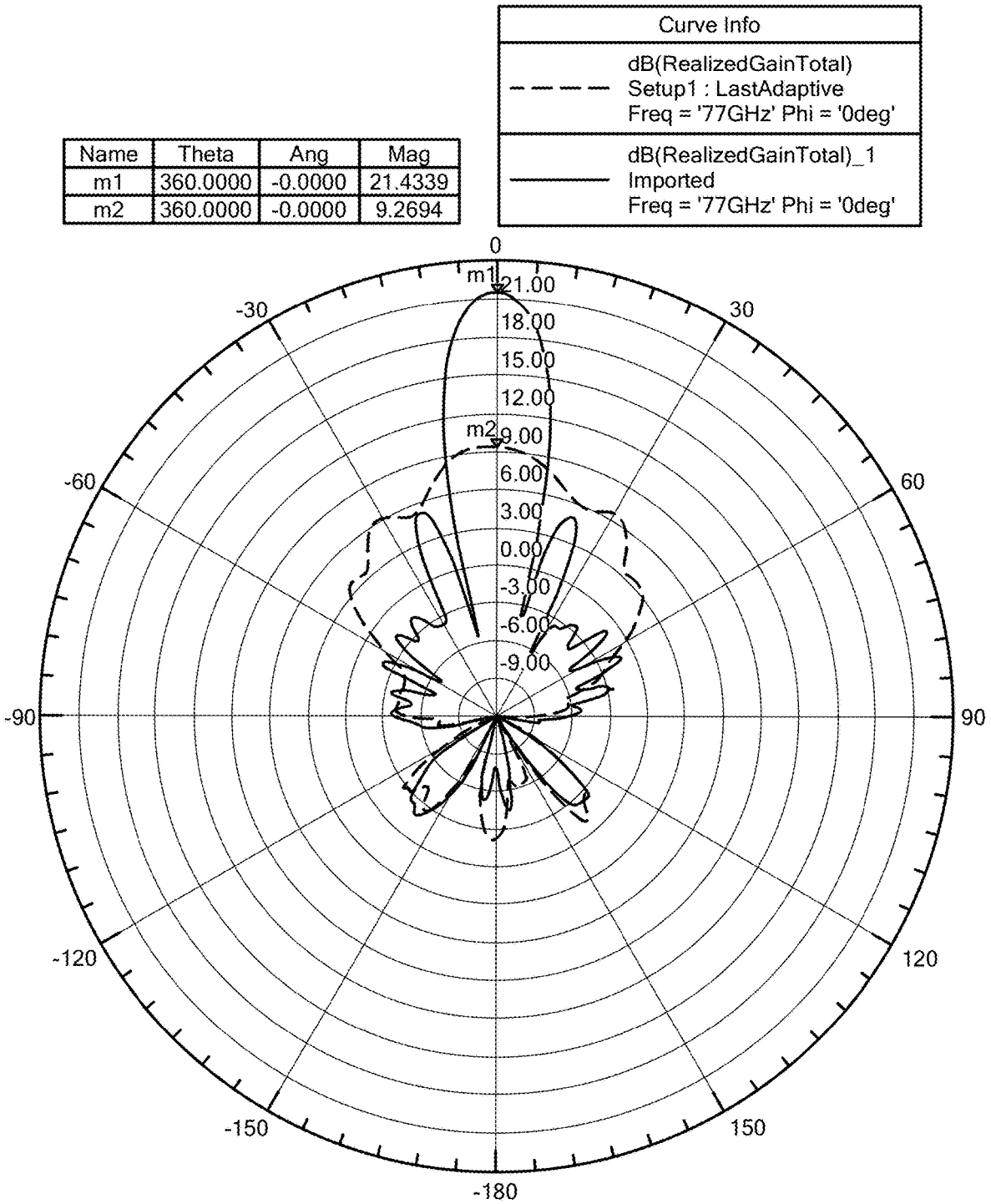
Figure 8E:
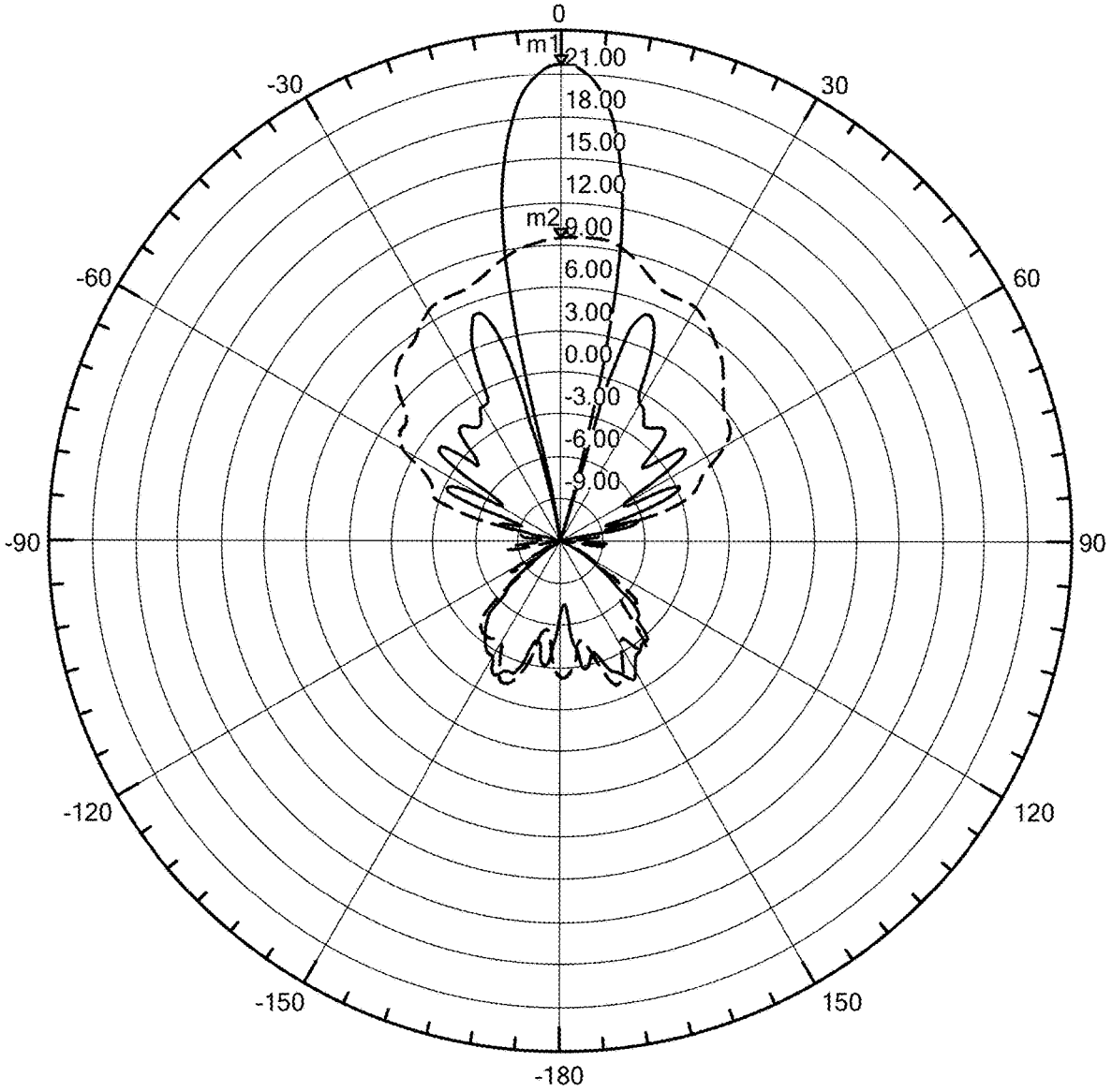

FIGS. 8D and 8E depict realized gain total (dBi) of the far field radiation pattern in the y-z plane and the x-z plane, respectively, and compares the gain of a DRA system with a dielectric lens 400 of 20 millimeter diameter (solid line plot) with the gain of a similar DRA system but without the dielectric lens 400 (dashed line plot). As may be seen, the inclusion of a dielectric lens 400 with a DRA 200 as disclosed herein, produces analytical results that show an increase in far field gain from about 9.3 dBi to about 21.4 dBi in both the y-z plane and the x-z plane.

In an embodiment where the body of dielectric material 400 is a spherical shaped dielectric material having a spherical outer surface defined by a spherical radius R (see FIGS. 1B, 5A, 5B, and 5C, for example), each DRA 200 of the array of DRAs 210 are disposed such that a far field electromagnetic radiation boresight 216 of the each DRA 200, when electromagnetically excited, is oriented substantially radially aligned with the spherical radius R.

In an embodiment where the body of dielectric material 400.1 is a toroidal shaped dielectric material having a toroidal outer surface defined by a toroidal radius R1 (see FIG. 1C, for example), each DRA 200 of the array of DRAs 210 are disposed such that a far field electromagnetic radiation boresight 216 of the each DRA 200, when electromagnetically excited, is oriented substantially radially aligned with the toroidal radius R1.

In an embodiment where the body of dielectric material 400.2 is a hemispherical shaped dielectric material having a hemispherical outer surface defined by a hemispherical radius R2 (see FIG. 1D, for example), each DRA 200 of the array of DRAs 210 are disposed such that a far field electromagnetic radiation boresight 216 of the each DRA 200, when electromagnetically excited, is oriented substantially radially aligned with the hemispherical radius R2.

In an embodiment where the body of dielectric material 400.3 is a cylindrical shaped dielectric material having a cylindrical outer surface defined by a cylindrical radius R3 (see FIG. 1E, for example), each DRA 200 of the array of DRAs 210 are disposed such that a far field electromagnetic radiation boresight 216 of the each DRA 200, when electromagnetically excited, is oriented substantially radially aligned with the cylindrical radius R3.

In an embodiment where the body of dielectric material 400.4 is a hemicylindrical shaped dielectric material having a hemicylindrical outer surface defined by a hemicylindrical radius R4 (see FIG. 1F, for example), each DRA 200 of the array of DRAs 210 are disposed such that a far field electromagnetic radiation boresight 216 of the each DRA 200, when electromagnetically excited, is oriented substantially radially aligned with the hemicylindrical radius R4.

As will be appreciated from all of the foregoing, the arrangement of DRAs 200 on the body of dielectric material 400, 400.1, 400.2, 400.3, 400.4 (herein collectively referred to as 400.*x*), as disclosed herein, are merely illustrations of the myriad of possible arrangements. As such, any and all such arrangements that fall within a scope of the appended claims are contemplated and considered to fall within the ambit of an invention disclosed herein.

Further to all of the foregoing, it will be appreciated that in some embodiments the dielectric constant of the dielectric material 400.*x* may vary along the depicted radii R, R1, R2, R3, R4 (herein collectively referred to as Rx). However, in other embodiments the particular variation of the subject dielectric constant may be dependent on where the radiating feed(s) of each DRA 200 are placed. Generally speaking, to obtain higher far field gain, it would be beneficial to have the dielectric constant decrease as you move laterally away from the boresight of the feed point. In a more generally sense then, the subject dielectric constant may be configured to vary across the subject dielectric structure in any desired and specified direction, and need not necessarily be limited to just varying along one of the herein defined radial directions.

The dielectric materials for use herein are selected to provide the desired electrical and mechanical properties for a purpose disclosed herein. The dielectric materials generally comprise, but may not be limited to, a thermoplastic or thermosetting polymer matrix and a filler composition containing a dielectric filler. The dielectric volume may comprise, based on the volume of the dielectric volume, 30 to 100 volume percent (vol %) of a polymer matrix, and 0 to 70 vol % of a filler composition, specifically 30 to 99 vol % of a polymer matrix and 1 to 70 vol % of a filler composition, more specifically 50 to 95 vol % of a polymeric matrix and 5 to 50 vol % of a filler composition. The polymer matrix and the filler are selected to provide a dielectric volume having a dielectric constant consistent for a purpose disclosed herein and a dissipation factor of less than 0.006, specifically, less than or equal to 0.0035 at 10 GigaHertz (GHz). The dissipation factor may be measured by the IPC-TM-650 X-band strip line method or by the Split Resonator method.

In an embodiment, the dielectric volume comprises a low polarity, low dielectric constant, and low loss polymer. The polymer may comprise 1,2-polybutadiene (PBD), polyisoprene, polybutadiene-polyisoprene copolymers, polyetherimide (PEI), fluoropolymers such as polytetrafluoroethylene (PTFE), polyimide, polyetheretherketone (PEEK), polyamidimide, polyethylene terephthalate (PET), polyethylene naphthalate, polycyclohexylene terephthalate, polyphenylene ethers, those based on allylated polyphenylene ethers, or a combination comprising at least one of the foregoing. Combinations of low polarity polymers with higher polarity polymers may also be used, non-limiting examples including epoxy and poly(phenylene ether), epoxy and poly(etherimide), cyanate ester and poly(phenylene ether), and 1,2-polybutadiene and polyethylene.

Fluoropolymers include fluorinated homopolymers, e.g., PTFE and polychlorotrifluoroethylene (PCTFE), and fluorinated copolymers, e.g. copolymers of tetrafluoroethylene or chlorotrifluoroethylene with a monomer such as hexafluoropropylene or perfluoroalkylvinylethers, vinylidene fluoride, vinyl fluoride, ethylene, or a combination comprising at least one of the foregoing. The fluoropolymer may comprise a combination of different at least one these fluoropolymers.

The polymer matrix may comprise thermosetting polybutadiene or polyisoprene. As used herein, the term "thermosetting polybutadiene or polyisoprene" includes homopolymers and copolymers comprising units derived from butadiene, isoprene, or combinations thereof. Units derived from other copolymerizable monomers may also be present in the polymer, for example, in the form of grafts. Exemplary copolymerizable monomers include, but are not limited to, vinylaromatic monomers, for example substituted and unsubstituted monovinylaromatic monomers such as styrene, 3-methylstyrene, 3,5-diethylstyrene, 4-n-propylstyrene, alpha-methylstyrene, alpha-methyl vinyltoluene, para-hydroxystyrene, para-methoxystyrene, alpha-chlorostyrene, alpha-bromostyrene, dichlorostyrene, dibromostyrene, tetrachlorostyrene, and the like; and substituted and unsubstituted divinylaromatic monomers such as divinylbenzene, divinyltoluene, and the like. Combinations comprising at least one of the foregoing copolymerizable monomers may also be used. Exemplary thermosetting polybutadiene or polyisoprenes include, but are not limited to, butadiene homopolymers, isoprene homopolymers, butadiene-vinylaromatic copolymers such as butadiene-styrene, isoprene-vinylaromatic copolymers such as isoprene-styrene copolymers, and the like.

The thermosetting polybutadiene or polyisoprenes may also be modified. For example, the polymers may be hydroxyl-terminated, methacrylate-terminated, carboxylate-terminated, or the like. Post-reacted polymers may be used, such as epoxy-, maleic anhydride-, or urethane-modified polymers of butadiene or isoprene polymers. The polymers may also be crosslinked, for example by divinylaromatic compounds such as divinyl benzene, e.g., a polybutadiene-styrene crosslinked with divinyl benzene. Exemplary materials are broadly classified as "polybutadienes" by their manufacturers, for example, Nippon Soda Co., Tokyo, Japan, and Cray Valley Hydrocarbon Specialty Chemicals, Exton, Pa. Combinations may also be used, for example, a combination of a polybutadiene homopolymer and a poly (butadiene-isoprene) copolymer. Combinations comprising a syndiotactic polybutadiene may also be useful.

The thermosetting polybutadiene or polyisoprene may be liquid or solid at room temperature. The liquid polymer may have a number average molecular weight (Mn) of greater than or equal to 5,000 g/mol. The liquid polymer may have an Mn of less than 5,000 g/mol, specifically, 1,000 to 3,000 g/mol. Thermosetting polybutadiene or polyisoprenes having at least 90 wt % 1.2 addition, which may exhibit greater crosslink density upon cure due to the large number of pendent vinyl groups available for crosslinking.

The polybutadiene or polyisoprene may be present in the polymer composition in an amount of up to 100 wt %, specifically, up to 75 wt % with respect to the total polymer matrix composition, more specifically, 10 to 70 wt %, even more specifically, 20 to 60 or 70 wt %, based on the total polymer matrix composition.

Other polymers that may co-cure with the thermosetting polybutadiene or polyisoprenes may be added for specific property or processing modifications. For example, in order to improve the stability of the dielectric strength and mechanical properties of the dielectric material over time, a lower molecular weight ethylene-propylene elastomer may be used in the systems. An ethylene-propylene elastomer as used herein is a copolymer, terpolymer, or other polymer comprising primarily ethylene and propylene. Ethylene-propylene elastomers may be further classified as EPM copolymers (i.e., copolymers of ethylene and propylene monomers) or EPDM terpolymers (i.e., terpolymers of ethylene, propylene, and diene monomers). Ethylene-propylene-diene terpolymer rubbers, in particular, have saturated main chains, with unsaturation available off the main chain for facile cross-linking. Liquid ethylene-propylene-diene terpolymer rubbers, in which the diene is dicyclopentadiene, may be used.

The molecular weights of the ethylene-propylene rubbers may be less than 10,000 g/mol viscosity average molecular weight (Mv). The ethylene-propylene rubber may include an ethylene-propylene rubber having an Mv of 7,200 g/mol, which is available from Lion Copolymer, Baton Rouge, La., under the trade name TRILENE™ CP80; a liquid ethylene-propylene-dicyclopentadiene terpolymer rubbers having an Mv of 7,000 g/mol, which is available from Lion Copolymer under the trade name of TRILENE™ 65; and a liquid ethylene-propylene-ethylidene norbornene terpolymer having an Mv of 7,500 g/mol, which is available from Lion Copolymer under the name TRILENE™ 67.

The ethylene-propylene rubber may be present in an amount effective to maintain the stability of the properties of the dielectric material over time, in particular the dielectric strength and mechanical properties. Typically, such amounts are up to 20 wt % with respect to the total weight of the polymer matrix composition, specifically, 4 to 20 wt %, more specifically, 6 to 12 wt %.

Another type of co-curable polymer is an unsaturated polybutadiene- or polyisoprene-containing elastomer. This component may be a random or block copolymer of primarily 1,3-addition butadiene or isoprene with an ethylenically unsaturated monomer, for example, a vinylaromatic compound such as styrene or alpha-methyl styrene, an acrylate or methacrylate such a methyl methacrylate, or acrylonitrile. The elastomer may be a solid, thermoplastic elastomer comprising a linear or graft-type block copolymer having a polybutadiene or polyisoprene block and a thermoplastic block that may be derived from a monovinylaromatic monomer such as styrene or alpha-methyl styrene. Block copolymers of this type include styrene-butadiene-styrene triblock copolymers, for example, those available from Dexco Polymers, Houston, Tex. under the trade name VECTOR 8508M™, from Enichem Elastomers America, Houston, Tex. under the trade name SOL-T-6302™, and those from Dynasol Elastomers under the trade name CALPRENE™ 401; and styrene-butadiene diblock copolymers and mixed triblock and diblock copolymers containing styrene and butadiene, for example, those available from Kraton Polymers (Houston, Tex.) under the trade name KRATON D1118. KRATON D1118 is a mixed diblock/triblock styrene and butadiene containing copolymer that contains 33 wt % styrene.

The optional polybutadiene- or polyisoprene-containing elastomer may further comprise a second block copolymer similar to that described above, except that the polybutadiene or polyisoprene block is hydrogenated, thereby forming a polyethylene block (in the case of polybutadiene) or an ethylene-propylene copolymer block (in the case of polyisoprene). When used in conjunction with the above-described copolymer, materials with greater toughness may be produced. An exemplary second block copolymer of this type is KRATON GX1855 (commercially available from Kraton Polymers, which is believed to be a combination of a styrene-high 1,2-butadiene-styrene block copolymer and a styrene-(ethylene-propylene)-styrene block copolymer.

The unsaturated polybutadiene- or polyisoprene-containing elastomer component may be present in the polymer matrix composition in an amount of 2 to 60 wt % with respect to the total weight of the polymer matrix composition, specifically, 5 to 50 wt %, more specifically, 10 to 40 or 50 wt %.

Still other co-curable polymers that may be added for specific property or processing modifications include, but are not limited to, homopolymers or copolymers of ethylene such as polyethylene and ethylene oxide copolymers; natural rubber; norbornene polymers such as polydicyclopentadiene; hydrogenated styrene-isoprene-styrene copolymers and butadiene-acrylonitrile copolymers; unsaturated polyesters; and the like. Levels of these copolymers are generally less than 50 wt % of the total polymer in the polymer matrix composition.

Free radical-curable monomers may also be added for specific property or processing modifications, for example to increase the crosslink density of the system after cure. Exemplary monomers that may be suitable crosslinking agents include, for example, di, tri-, or higher ethylenically unsaturated monomers such as divinyl benzene, triallyl cyanurate, diallyl phthalate, and multifunctional acrylate monomers (e.g., SARTOMER™ polymers available from Sartomer USA, Newtown Square, Pa.), or combinations thereof, all of which are commercially available. The crosslinking agent, when used, may be present in the polymer matrix composition in an amount of up to 20 wt %, specifically, 1 to 15 wt %, based on the total weight of the total polymer in the polymer matrix composition.

A curing agent may be added to the polymer matrix composition to accelerate the curing reaction of polyenes having olefinic reactive sites. Curing agents may comprise organic peroxides, for example, dicumyl peroxide, t-butyl perbenzoate, 2,5-dimethyl-2,5-di(t-butyl peroxy)hexane, α,α-di-bis(t-butyl peroxy)diisopropylbenzene, 2,5-dimethyl-2,5-di(t-butyl peroxy) hexyne-3, or a combination comprising at least one of the foregoing. Carbon-carbon initiators, for example, 2,3-dimethyl-2,3 diphenylbutane may be used. Curing agents or initiators may be used alone or in combination. The amount of curing agent may be 1.5 to 10 wt % based on the total weight of the polymer in the polymer matrix composition.

In some embodiments, the polybutadiene or polyisoprene polymer is carboxy-functionalized. Functionalization may be accomplished using a polyfunctional compound having in the molecule both (i) a carbon-carbon double bond or a carbon-carbon triple bond, and (ii) at least one of a carboxy group, including a carboxylic acid, anhydride, amide, ester, or acid halide. A specific carboxy group is a carboxylic acid or ester. Examples of polyfunctional compounds that may provide a carboxylic acid functional group include maleic acid, maleic anhydride, fumaric acid, and citric acid. In particular, polybutadienes adducted with maleic anhydride may be used in the thermosetting composition. Suitable maleinized polybutadiene polymers are commercially available, for example from Cray Valley under the trade names RICON 130MA8, RICON 130MA13, RICON 130MA20, RICON 131MA5, RICON 131MA10, RICON 131MA17, RICON 131MA20, and RICON 156MA17. Suitable maleinized polybutadiene-styrene copolymers are commercially available, for example, from Sartomer under the trade names RICON 184MA6. RICON 184MA6 is a butadiene-styrene copolymer adducted with maleic anhydride having styrene content of 17 to 27 wt % and Mn of 9,900 g/mol.

The relative amounts of the various polymers in the polymer matrix composition, for example, the polybutadiene or polyisoprene polymer and other polymers, may depend on the particular conductive metal ground plate layer used, the desired properties of the circuit materials, and like considerations. For example, use of a poly(arylene ether) may provide increased bond strength to a conductive metal component, for example, a copper or aluminum component such as a signal feed, ground, or reflector component. Use of a polybutadiene or polyisoprene polymer may increase high temperature resistance of the composites, for example, when these polymers are carboxy-functionalized. Use of an elastomeric block copolymer may function to compatibilize the components of the polymer matrix material. Determination of the appropriate quantities of each component may be done without undue experimentation, depending on the desired properties for a particular application.

The dielectric volume may further include a particulate dielectric filler selected to adjust the dielectric constant, dissipation factor, coefficient of thermal expansion, and other properties of the dielectric volume. The dielectric filler may comprise, for example, titanium dioxide (rutile and anatase), barium titanate, strontium titanate, silica (including fused amorphous silica), corundum, wollastonite, $Ba_2Ti_9O_{20}$, solid glass spheres, synthetic glass or ceramic hollow spheres, quartz, boron nitride, aluminum nitride, silicon carbide, beryllia, alumina, alumina trihydrate, magnesia, mica, talcs, nanoclays, magnesium hydroxide, or a combination comprising at least one of the foregoing. A single secondary filler, or a combination of secondary fillers, may be used to provide a desired balance of properties.

Optionally, the fillers may be surface treated with a silicon-containing coating, for example, an organofunctional alkoxy silane coupling agent. A zirconate or titanate coupling agent may be used. Such coupling agents may improve the dispersion of the filler in the polymeric matrix and reduce water absorption of the finished DRA. The filler component may comprise 5 to 50 vol % of the microspheres and 70 to 30 vol % of fused amorphous silica as secondary filler based on the weight of the filler.

The dielectric volume may also optionally contain a flame retardant useful for making the volume resistant to flame. These flame retardant may be halogenated or unhalogenated. The flame retardant may be present in in the dielectric volume in an amount of 0 to 30 vol % based on the volume of the dielectric volume.

In an embodiment, the flame retardant is inorganic and is present in the form of particles. An exemplary inorganic flame retardant is a metal hydrate, having, for example, a volume average particle diameter of 1 nm to 500 nm, preferably 1 to 200 nm, or 5 to 200 nm, or 10 to 200 nm; alternatively the volume average particle diameter is 500 nm to 15 micrometer, for example 1 to 5 micrometer. The metal hydrate is a hydrate of a metal such as Mg, Ca, Al, Fe, Zn, Ba, Cu, Ni, or a combination comprising at least one of the foregoing. Hydrates of Mg, Al, or Ca are particularly preferred, for example aluminum hydroxide, magnesium hydroxide, calcium hydroxide, iron hydroxide, zinc hydroxide, copper hydroxide and nickel hydroxide; and hydrates of calcium aluminate, gypsum dihydrate, zinc borate and barium metaborate. Composites of these hydrates may be used, for example a hydrate containing Mg and one or more of Ca, Al, Fe, Zn, Ba, Cu and Ni. A preferred composite metal hydrate has the formula $MgMx\cdot(OH)_y$ wherein M is Ca, Al, Fe, Zn, Ba, Cu, or Ni, x is 0.1 to 10, and y is from 2 to 32. The flame retardant particles may be coated or otherwise treated to improve dispersion and other properties.

Organic flame retardants may be used, alternatively or in addition to the inorganic flame retardants. Examples of inorganic flame retardants include melamine cyanurate, fine particle size melamine polyphosphate, various other phosphorus-containing compounds such as aromatic phosphinates, diphosphinates, phosphonates, and phosphates, certain polysilsesquioxanes, siloxanes, and haloenated comgpounds such as hexachloroendomethylenetetrahydrophthalic acid (HET acid), tetrabromophthalic acid and dibromoneopentyl glycol A flame retardant (such as a bromine-containing flame retardant) may be present in an amount of 20 phr (parts per hundred parts of resin) to 60 phr, specifically, 30 to 45 phr. Examples of brominated flame retardants include Saytex BT93W (ethylene bistetrabromophthalimide), Saytex 120 (tetradecabromodiphenoxy benzene), and Saytex 102 (decabromodiphenyl oxide). The flame retardant may be used in combination with a synergist, for example a halogenated flame retardant may be used in combination with a synergists such as antimony trioxide, and a phosphorus-containing flame retardant may be used in combination with a nitrogen-containing compound such as melamine.

The volume of dielectric material may be formed from a dielectric composition comprising the polymer matrix composition and the filler composition. The volume may be formed by casting a dielectric composition directly onto the ground structure layer, or a dielectric volume may be produced that may be deposited onto the ground structure layer. The method to produce the dielectric volume may be based on the polymer selected. For example, where the polymer comprises a fluoropolymer such as PTFE, the polymer may be mixed with a first carrier liquid. The combination may comprise a dispersion of polymeric particles in the first carrier liquid, e.g., an emulsion of liquid droplets of the polymer or of a monomeric or oligomeric precursor of the polymer in the first carrier liquid, or a solution of the polymer in the first carrier liquid. If the polymer is liquid, then no first carrier liquid may be necessary.

The choice of the first carrier liquid, if present, may be based on the particular polymeric and the form in which the polymeric is to be introduced to the dielectric volume. If it is desired to introduce the polymeric as a solution, a solvent for the particular polymer is chosen as the carrier liquid, e.g., N-methyl pyrrolidone (NMP) would be a suitable carrier liquid for a solution of a polyimide. If it is desired to introduce the polymer as a dispersion, then the carrier liquid may comprise a liquid in which the is not soluble, e.g., water would be a suitable carrier liquid for a dispersion of PTFE particles and would be a suitable carrier liquid for an emulsion of polyamic acid or an emulsion of butadiene monomer.

The dielectric filler component may optionally be dispersed in a second carrier liquid, or mixed with the first carrier liquid (or liquid polymer where no first carrier is used). The second carrier liquid may be the same liquid or may be a liquid other than the first carrier liquid that is miscible with the first carrier liquid. For example, if the first carrier liquid is water, the second carrier liquid may comprise water or an alcohol. The second carrier liquid may comprise water.

The filler dispersion may comprise a surfactant in an amount effective to modify the surface tension of the second carrier liquid to enable the second carrier liquid to wet the borosilicate microspheres. Exemplary surfactant compounds include ionic surfactants and nonionic surfactants. TRITON X-100™, has been found to be an exemplary surfactant for use in aqueous filler dispersions. The filler dispersion may comprise 10 to 70 vol % of filler and 0.1 to 10 vol % of surfactant, with the remainder comprising the second carrier liquid.

The combination of the polymer and first carrier liquid and the filler dispersion in the second carrier liquid may be combined to form a casting mixture. In an embodiment, the casting mixture comprises 10 to 60 vol % of the combined polymer and filler and 40 to 90 vol % combined first and second carrier liquids. The relative amounts of the polymer and the filler component in the casting mixture may be selected to provide the desired amounts in the final composition as described below.

The viscosity of the casting mixture may be adjusted by the addition of a viscosity modifier, selected on the basis of its compatibility in a particular carrier liquid or combination of carrier liquids, to retard separation, i.e. sedimentation or flotation, of the hollow sphere filler from the dielectric composite material and to provide a dielectric composite material having a viscosity compatible with conventional manufacturing equipment. Exemplary viscosity modifiers suitable for use in aqueous casting mixtures include, e.g., polyacrylic acid compounds, vegetable gums, and cellulose based compounds. Specific examples of suitable viscosity modifiers include polyacrylic acid, methyl cellulose, polyethyleneoxide, guar gum, locust bean gum, sodium carboxymethylcellulose, sodium alginate, and gum tragacanth. The viscosity of the viscosity-adjusted casting mixture may be further increased, i.e., beyond the minimum viscosity, on an application by application basis to adapt the dielectric composite material to the selected manufacturing technique. In an embodiment, the viscosity-adjusted casting mixture may exhibit a viscosity of 10 to 100,000 centipoise (cp); specifically, 100 cp and 10,000 cp measured at room temperature value.

Alternatively, the viscosity modifier may be omitted if the viscosity of the carrier liquid is sufficient to provide a casting mixture that does not separate during the time period of interest. Specifically, in the case of extremely small particles, e.g., particles having an equivalent spherical diameter less than 0.1 micrometers, the use of a viscosity modifier may not be necessary.

A layer of the viscosity-adjusted casting mixture may be cast onto the ground structure layer, or may be dip-coated and then shaped. The casting may be achieved by, for example, dip coating, flow coating, reverse roll coating, knife-over-roll, knife-over-plate, metering rod coating, and the like.

The carrier liquid and processing aids, i.e., the surfactant and viscosity modifier, may be removed from the cast volume, for example, by evaporation or by thermal decomposition in order to consolidate a dielectric volume of the polymer and the filler comprising the microspheres.

The volume of the polymeric matrix material and filler component may be further heated to modify the physical properties of the volume, e.g., to sinter a thermoplastic or to cure or post cure a thermosetting composition.

In another method, a PTFE composite dielectric volume may be made by a paste extrusion and calendaring process.

In still another embodiment, the dielectric volume may be cast and then partially cured ("B-staged"). Such B-staged volumes may be stored and used subsequently.

An adhesion layer may be disposed between the conductive ground layer and the dielectric volume. The adhesion layer may comprise a poly(arylene ether); and a carboxy-functionalized polybutadiene or polyisoprene polymer comprising butadiene, isoprene, or butadiene and isoprene units, and zero to less than or equal to 50 wt % of co-curable monomer units; wherein the composition of the adhesive layer is not the same as the composition of the dielectric volume. The adhesive layer may be present in an amount of 2 to 15 grams per square meter. The poly(arylene ether) may comprise a carboxy-functionalized poly(arylene ether). The poly(arylene ether) may be the reaction product of a poly (arylene ether) and a cyclic anhydride or the reaction product of a poly(arylene ether) and maleic anhydride. The carboxy-functionalized polybutadiene or polyisoprene polymer may be a carboxy-functionalized butadiene-styrene copolymer. The carboxy-functionalized polybutadiene or polyisoprene polymer may be the reaction product of a polybutadiene or polyisoprene polymer and a cyclic anhydride. The carboxy-functionalized polybutadiene or polyisoprene polymer may be a maleinized polybutadiene-styrene or maleinized polyisoprene-styrene copolymer.

In an embodiment, a multiple-step process suitable for thermosetting materials such as polybutadiene or polyisoprene may comprise a peroxide cure step at temperatures of 150 to 200° C., and the partially cured (B-staged) stack may then be subjected to a high-energy electron beam irradiation cure (E-beam cure) or a high temperature cure step under an inert atmosphere. Use of a two-stage cure may impart an unusually high degree of cross-linking to the resulting composite. The temperature used in the second stage may be 250 to 300° C., or the decomposition temperature of the polymer. This high temperature cure may be carried out in an oven but may also be performed in a press, namely as a continuation of the initial fabrication and cure step. Particular fabrication temperatures and pressures will depend upon the particular adhesive composition and the dielectric composition, and are readily ascertainable by one of ordinary skill in the art without undue experimentation.

Molding allows rapid and efficient manufacture of the dielectric volume, optionally together with another DRA component(s) as an embedded feature or a surface feature. For example, a metal, ceramic, or other insert may be placed in the mold to provide a component of the DRA, such as a signal feed, ground component, or reflector component as embedded or surface feature. Alternatively, an embedded feature may be 3D printed or inkjet printed onto a volume, followed by further molding; or a surface feature may be 3D printed or inkjet printed onto an outermost surface of the DRA. It is also possible to mold the volume directly onto the ground structure, or into a container comprising a material having a dielectric constant between 1 and 3.

The mold may have a mold insert comprising a molded or machined ceramic to provide the package or volume. Use of a ceramic insert may lead to lower loss resulting in higher efficiency; reduced cost due to low direct material cost for molded alumina; ease of manufactured and controlled (constrained) thermal expansion of the polymer. It may also provide a balanced coefficient of thermal expansion (CTE) such that the overall structure matches the CTE of copper or aluminum.

The injectable composition may be prepared by first combining the ceramic filler and the silane to form a filler composition and then mixing the filler composition with the thermoplastic polymer or thermosetting composition. For a thermoplastic polymer, the polymer may be melted prior to, after, or during the mixing with one or both of the ceramic filler and the silane. The injectable composition may then be injection molded in a mold. The melt temperature, the injection temperature, and the mold temperature used depend on the melt and glass transition temperature of the thermoplastic polymer, and may be, for example, 150 to 350° C., or 200 to 300° C. The molding may occur at a pressure of 65 to 350 kiloPascal (kPa).

In some embodiments, the dielectric volume may be prepared by reaction injection molding a thermosetting composition. The reaction injection molding may comprise mixing at least two streams to form a thermosetting composition, and injecting the thermosetting composition into the mold, wherein a first stream comprises the catalyst and the second stream optionally comprises an activating agent. One or both of the first stream and the second stream or a third stream may comprise a monomer or a curable composition. One or both of the first stream and the second stream or a third stream may comprise one or both of a dielectric filler and an additive. One or both of the dielectric filler and the additive may be added to the mold prior to injecting the thermosetting composition.

For example, a method of preparing the volume may comprise mixing a first stream comprising the catalyst and a first monomer or curable composition and a second stream comprising the optional activating agent and a second monomer or curable composition. The first and second monomer or curable composition may be the same or different. One or both of the first stream and the second stream may comprise the dielectric filler. The dielectric filler may be added as a third stream, for example, further comprising a third monomer. The dielectric filler may be in the mold prior to injection of the first and second streams. The introducing of one or more of the streams may occur under an inert gas, for example, nitrogen or argon.

The mixing may occur in a head space of an injection molding machine, or in an inline mixer, or during injecting into the mold. The mixing may occur at a temperature of greater than or equal to 0 to 200 degrees Celsius (° C.), specifically, 15 to 130° C., or 0 to 45° C., more specifically, 23 to 45° C.

The mold may be maintained at a temperature of greater than or equal to 0 to 250° C., specifically, 23 to 200° C. or 45 to 250° C., more specifically, 30 to 130° C. or 50 to 70° C. It may take 0.25 to 0.5 minutes to fill a mold, during which time, the mold temperature may drop. After the mold is filled, the temperature of the thermosetting composition may increase, for example, from a first temperature of 0° to 45° C. to a second temperature of 45 to 250° C. The molding may occur at a pressure of 65 to 350 kiloPascal (kPa). The molding may occur for less than or equal to 5 minutes, specifically, less than or equal to 2 minutes, more specifically, 2 to 30 seconds. After the polymerization is complete, the substrate may be removed at the mold temperature or at a decreased mold temperature. For example, the release temperature, $T_r$, may be less than or equal to 10° C. less than the molding temperature, $T_m$ ($T_r \leq T_m - 10°$ C.).

After the volume is removed from the mold, it may be post-cured. Post-curing may occur at a temperature of 100 to 150° C., specifically, 140 to 200° C. for greater than or equal to 5 minutes.

Compression molding may be used with either thermoplastic or thermosetting materials. Conditions for compression molding a thermoplastic material, such as mold temperature, depend on the melt and glass transition temperature of the thermoplastic polymer, and may be, for example, 150 to 350° C., or 200 to 300° C. The molding may occur at a pressure of 65 to 350 kiloPascal (kPa). The molding may occur for less than or equal to 5 minutes, specifically, less than or equal to 2 minutes, more specifically, 2 to 30 seconds. A thermosetting material may be compression molded before B-staging to produce a B-stated material or a fully cured material; or it may be compression molded after it has been B-staged, and fully cured in the mold or after molding.

3D printing allows rapid and efficient manufacture of the dielectric volume, optionally together with another DRA component(s) as an embedded feature or a surface feature. For example, a metal, ceramic, or other insert may be placed during printing provide a component of the DRA, such as a signal feed, ground component, or reflector component as embedded or surface feature. Alternatively, an embedded feature may be 3D printed or inkjet printed onto a volume, followed by further printing; or a surface feature may be 3D printed or inkjet printed onto an outermost surface of the DRA. It is also possible to 3D print the volume directly onto the ground structure, or into the container comprising a material having a dielectric constant between 1 and 3, where the container may be useful for embedding a unit cells of an array.

A wide variety of 3D printing methods may be used, for example fused deposition modeling (FDM), selective laser sintering (SLS), selective laser melting (SLM), electronic beam melting (EBM), Big Area Additive Manufacturing (BAAM), ARBURG plastic free forming technology, laminated object manufacturing (LOM), pumped deposition (also known as controlled paste extrusion, as described, for example, at: http://nscrypt.com/micro-dispensing), or other 3D printing methods. 3D printing may be used in the manufacture of prototypes or as a production process. In some embodiments the volume or the DRA is manufactured only by 3D or inkjet printing, such that the method of forming the dielectric volume or the DRA is free of an extrusion, molding, or lamination process.

Material extrusion techniques are particularly useful with thermoplastics, and may be used to provide intricate features. Material extrusion techniques include techniques such as FDM, pumped deposition, and fused filament fabrication, as well as others as described in ASTM F2792-12a. In fused material extrusion techniques, an article may be produced by heating a thermoplastic material to a flowable state that may be deposited to form a layer. The layer may have a predetermined shape in the x-y axis and a predetermined thickness in the z-axis. The flowable material may be deposited as roads as described above, or through a die to provide a specific profile. The layer cools and solidifies as it is deposited. A subsequent layer of melted thermoplastic material fuses to the previously deposited layer, and solidifies upon a drop in temperature. Extrusion of multiple subsequent layers builds the desired shape of the volume. In particular, an article may be formed from a three-dimensional digital representation of the article by depositing the flowable material as one or more roads on a substrate in an x-y plane to form the layer. The position of the dispenser (e.g., a nozzle) relative to the substrate is then incremented along a z-axis (perpendicular to the x-y plane), and the process is then repeated to form an article from the digital representation. The dispensed material is thus also referred to as a "modeling material" as well as a "build material."

In some embodiments the volume may be extruded from two or more nozzles, each extruding the same dielectric composition. If multiple nozzles are used, the method may produce the product objects faster than methods that use a single nozzle, and may allow increased flexibility in terms of using different polymers or blends of polymers, different colors, or textures, and the like. Accordingly, in an embodiment, a composition or property of a single volume may be varied during deposition using two nozzles.

Material extrusion techniques may further be used of the deposition of thermosetting compositions. For example, at least two streams may be mixed and deposited to form the volume. A first stream may include catalyst and a second stream may optionally comprise an activating agent. One or both of the first stream and the second stream or a third stream may comprise the monomer or curable composition (e.g., resin). One or both of the first stream and the second stream or a third stream may comprise one or both of a dielectric filler and an additive. One or both of the dielectric filler and the additive may be added to the mold prior to injecting the thermosetting composition.

For example, a method of preparing the volume may comprise mixing a first stream comprising the catalyst and a first monomer or curable composition and a second stream comprising the optional activating agent and a second monomer or curable composition. The first and second monomer or curable composition may be the same or different. One or both of the first stream and the second stream may comprise the dielectric filler. The dielectric filler may be added as a third stream, for example, further comprising a third monomer. The depositing of one or more of the streams may occur under an inert gas, for example, nitrogen or argon. The mixing may occur prior to deposition, in an inline mixer, or during deposition of the layer. Full or partial curing (polymerization or crosslinking) may be initiated prior to deposition, during deposition of the layer, or after deposition. In an embodiment, partial curing is initiated prior to or during deposition of the layer, and full curing is initiated after deposition of the layer or after deposition of the plurality of layers that provides the volume.

In some embodiments a support material as is known in the art may optionally be used to form a support structure. In these embodiments, the build material and the support material may be selectively dispensed during manufacture of the article to provide the article and a support structure. The support material may be present in the form of a support structure, for example a scaffolding that may be mechanically removed or washed away when the layering process is completed to the desired degree.

Stereolithographic techniques may also be used, such as selective laser sintering (SLS), selective laser melting (SLM), electronic beam melting (EBM), and powder bed jetting of binder or solvents to form successive layers in a preset pattern. Stereolithographic techniques are especially useful with thermosetting compositions, as the layer-by-layer buildup may occur by polymerizing or crosslinking each layer.

As described above, the dielectric composition may comprise a thermoplastic polymer or a thermosetting composition. The thermoplastic may be melted, or dissolved in a suitable solvent. The thermosetting composition may be a liquid thermosetting composition, or dissolved in a solvent. The solvent may be removed after applying the dielectric composition by heat, air drying, or other technique. The thermosetting composition may be B-staged, or fully polymerized or cured after applying to form the second volume. Polymerization or cure may be initiated during applying the dielectric composition.

Notwithstanding the foregoing, the inventors have unexpectedly found that the dielectric constant gradient provided by polyetherimides and polyetherimide foams, particularly layers of different densities, may provide Luneburg lenses having excellent properties for a purpose disclosed herein.

In an embodiment, a Luneburg lens comprises a multilayer polymeric structure, wherein each polymeric layer of the Luneburg lens has a different dielectric constant and optionally a different refractive index. In order to function as a Lunenburg lens, the lens has a dielectric constant gradient from the innermost to the outermost layer. Any of the above-described polymers may be used. In an embodiment each polymeric layer comprises a high performance polymer, which are generally aromatic and may have a decomposition temperature of 180° C. or higher, for example 180 to 400° C. or 200 to 350° C. Such polymers may also be referred to as engineering thermoplastics. Examples include polyamides, polyamideimides, polyarylene ethers (e.g., polyphenylene oxides (PPO) and their copolymers, often referred to as polyphenylene ethers (PPE)), polyarylene ether ketones (including polyether ether ketones (PEEK), polyether ketone ketones (PEKK), and the like), polyarylene sulfides (e.g., polyphenylene sulfides (PPS)), polyarylene ether sulfones (e.g., polyethersulfones (PES), polyphenylene sulfones (PPS), and the like) polycarbonates, polyetherimides, polyimides, polyphenylenesulfone ureas, polyphthalamides (PPA), or self-reinforced polyphenylene (SRP). The foregoing polymers may be linear or branched, and may be be homopolymers or copolymers, for example poly(etherimide-siloxane) or copolycarbonates containing two different types of carbonate units, for example bisphenol A units and units derived from a high heat monomer such as 3,3-bis(4-hydroxyphenyl)-2-phenylisoindolin-1-one. The copolymers may be random, alternating, graft, or block copolymers having two or more blocks of different homopolymers. A combination of at least two different polymers may be used.

In these embodiments, the polymer is in the form of a foam. "Foam" as used herein is inclusive of materials that have open pores, closed cells, or inclusions, such as ceramic or glass microspheres. Changing the amount of pores, cells, or inclusions results in changing the density of the foam, and hence the dielectric constant of the foam. A gradient of densities may accordingly be used to provide the dielectric constant gradient. The dielectric constant of each layer may further optionally be adjusted as needed by the addition of ceramic materials such as silica, titania, or the like, as is known in the art. Optionally, each layer of the lens has a different refractive index to provide the desired focusing properties.

The size and distribution of the pores, cells, or inclusions will vary depending on the polymer used and the desired dielectric constant. In an embodiment, the size of the cells may be from 100 square nanometer ($nm^2$) to 0.05 square millimeter ($mm^2$), or 1 square micrometer ($um^2$) to 10,000 $um^2$, or 1 $um^2$) to 1,000 $um^2$, where the foregoing are only exemplary. Preferably the cell size is uniform. For example, at least 50% of the pores are within ±20 microns of a single pore size selected on the basis of the density of the foam material.

Ceramic and glass microspheres include hollow and solid microspheres. In an embodiment glass microspheres are used, such as silica microspheres or borosilicate microspheres. Hollow microspheres typically have an outer shell made from a glass and an empty inner core that contains only gas. The particle size of the microspheres may be represented by the method of measuring particle size distribution. For example, the size of the microspheres may be described as the effective particle diameter in micrometers encompassing 95% by volume of the microspheres. The effective particle diameter of the microspheres may be 1 to 10,000 μm, or 1 to 1,000 μm, or 5 to 500 μm, 10 to 400 μm, 20 to 300 μm, 50 to 150 μm, or 75 to 125 μm, for example. Hollow glass microspheres may have a crush strength (ASTM D 3102-72) of 100 to 50,000 psi, 200 to 20,000 psi, 250 to 20,000 psi, 300 to 18,000 psi, 400 to 14,000 psi, 500 to 12,000 psi, 600 to 10,000 psi, 700 to 8,000 psi, 800 to 6,000 psi, 1,000 to 5,000 psi, 1,400 to 4,000 psi, 2,000 to 4,000 psi, or 2,500 to 3,500 psi.

In an embodiment, the polymer foam is a PEI foam. A large variety of PEI's are known and commercially available, and include homopolymers, copolymers (e.g., a block copolymer or a random copolymer), and the like. Exemplary copolymers include polyetherimide siloxanes, polyetherimid sulfones, and the like. In addition to the polyetherimide, the foam may comprise an additional polymer. Exemplary additional polymers include a wide variety of thermoplastic or thermoset polymers, some of which are described herein above. Preferably, if an additional polymer is used, it is also a high performance polymer. The polyetherimide foam may be a polyetherimide having a high concentration of small diameter cells, such as 0.1 μM to 500 μm cells. Exemplary polyetherimide foams are open cell polyetherimide foams such as the polyetherimide foams sold under the trade name ULTEM™ foam. ULTEM™ foams are lightweight, with low moisture absorption, low energy absorption, and low dielectric loss.

Embodiments disclosed herein may be suitable for a variety of antenna applications, such as microwave antenna applications operating within a frequency range of 1 GHz to 30 GHz, or such as millimeter-wave antenna applications operating within a frequency range of 30 GHz to 100 GHz, for example. In an embodiment, the microwave antenna applications may include an array of DRAs that are separate elements on separate substrates that are individually fed by corresponding electromagnetic signal feeds, and the millimeter-wave antenna applications may include an array of DRAs that are disposed on a common substrate. Additionally, non-planar antennas are of particular interest for conformal antenna applications.

When an element such as a layer, film, region, substrate, or other described feature is referred to as being "on" another element, it may be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. "Or" means "and/or" unless clearly stated otherwise. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms or dimensions may have been employed, they are unless otherwise stated used in a generic, exemplary or descriptive sense only and not for purposes of limitation, the scope of the claims therefore not being so limited.

What is claimed is:

1. An electromagnetic device, comprising:

an electrically conductive ground structure;

at least one dielectric resonator antenna (DRA) disposed on the ground structure;

at least one electromagnetic (EM) beam shaper disposed proximate a corresponding one of the DRA; and at least one signal feed disposed electromagnetically coupled to a corresponding one of the DRA;

wherein the at least one EM beam shaper comprises: an electrically conductive horn; a body of dielectric material having a dielectric constant that varies across the body of dielectric material in a specific direction; or, both the electrically conductive horn and the body of dielectric material;

wherein the at least one EM beam shaper comprises the body of dielectric material; and the body of dielectric material has a dielectric constant that decreases in a direction outwardly lateral from a boresight of a corresponding one of the at least one signal feed.

2. The device of claim 1, wherein:

the body of dielectric material is a spherical shaped dielectric material, and the spherical shaped dielectric material has a dielectric constant that varies from the center of the spherical shape to the outer surface of the spherical shape.

3. The device of claim 1, wherein:

the body of dielectric material is a hemispherical shaped dielectric material, and the hemispherical shaped dielectric material has a dielectric constant that varies from the center of a planar surface of the hemispherical shape to the outer surface of the hemispherical shape.

4. The device of claim 1, wherein:

the body of dielectric material is a cylindrical shaped dielectric material, and the cylindrical shaped dielectric material has a dielectric constant that varies from a central axis of the cylindrical shape to the outer surface of the cylindrical shape.

5. The device of claim 1, wherein:

the body of dielectric material is a toroidal shaped dielectric material, and the toroidal shaped dielectric material has a dielectric constant that varies from a central circular ring of the toroidal shape to an outer surface of the toroidal shape.

6. An electromagnetic device, comprising:
an electrically conductive ground structure;
at least one dielectric resonator antenna (DRA) disposed on the ground structure;
at least one electromagnetic (EM) beam shaper disposed proximate a corresponding one of the DRA; and
at least one signal feed disposed electromagnetically coupled to a corresponding one of the DRA;
wherein the at least one EM beam shaper comprises: an electrically conductive horn; a body of dielectric material having a dielectric constant that varies across the body of dielectric material in a specific direction; or, both the electrically conductive horn and the body of dielectric material;
wherein the at least one EM beam shaper comprises the body of dielectric material; and
the body of dielectric material is a hemicylindrical shaped dielectric material, and the hemicylindrical shaped dielectric material has a dielectric constant that varies from an axial center of a planar surface of the hemicylindrical shape to the outer surface of the hemicylindrical shape.

7. An electromagnetic device, comprising:
an electrically conductive ground structure;
at least one dielectric resonator antenna (DRA) disposed on the ground structure;
at least one electromagnetic (EM) beam shaper disposed proximate a corresponding one of the DRA; and
at least one signal feed disposed electromagnetically coupled to a corresponding one of the DRA;
wherein the at least one EM beam shaper comprises: an electrically conductive horn; a body of dielectric material having a dielectric constant that varies across the body of dielectric material in a specific direction; or, both the electrically conductive horn and the body of dielectric material;
wherein the at least one EM beam shaper comprises the body of dielectric material;
wherein the body of dielectric material comprises a non-foam;
wherein the non-foam material comprises a thermoplastic or thermosetting polymer matrix and a filler composition containing a dielectric filler.

8. An electromagnetic device, comprising:
an electrically conductive ground structure;
at least one dielectric resonator antenna (DRA) disposed on the ground structure;
at least one electromagnetic (EM) beam shaper disposed proximate a corresponding one of the DRA; and
at least one signal feed disposed electromagnetically coupled to a corresponding one of the DRA;
wherein the at least one EM beam shaper comprises: an electrically conductive horn; a body of dielectric material having a dielectric constant that varies across the body of dielectric material in a specific direction; or, both the electrically conductive horn and the body of dielectric material;
wherein the at least one EM beam shaper comprises the body of dielectric material;
wherein the body of dielectric material comprises a foam;
wherein the foam comprises a polyetherimide.

9. An electromagnetic device, comprising:
an electrically conductive ground structure;
at least one dielectric resonator antenna (DRA) disposed on the ground structure;
at least one electromagnetic (EM) beam shaper disposed proximate a corresponding one of the DRA; and
at least one signal feed disposed electromagnetically coupled to a corresponding one of the DRA;
wherein the at least one EM beam shaper comprises: an electrically conductive horn; a body of dielectric material having a dielectric constant that varies across the body of dielectric material in a specific direction; or, both the electrically conductive horn and the body of dielectric material;
wherein the at least one DRA comprises a single-layered DRA having a hollow core.

10. An electromagnetic device, comprising:
an electrically conductive ground structure;
at least one dielectric resonator antenna (DRA) disposed on the ground structure;
at least one electromagnetic (EM) beam shaper disposed proximate a corresponding one of the DRA; and
at least one signal feed disposed electromagnetically coupled to a corresponding one of the DRA;
wherein the at least one EM beam shaper comprises: an electrically conductive horn; a body of dielectric material having a dielectric constant that varies across the body of dielectric material in a specific direction; or, both the electrically conductive horn and the body of dielectric material;
wherein the at least one DRA comprises a multi-layered DRA having a hollow core.

11. An electromagnetic device, comprising:
an electrically conductive ground structure;
at least one dielectric resonator antenna (DRA) disposed on the ground structure;
at least one electromagnetic (EM) beam shaper disposed proximate a corresponding one of the DRA; and
at least one signal feed disposed electromagnetically coupled to a corresponding one of the DRA;
wherein the at least one EM beam shaper comprises: an electrically conductive horn; a body of dielectric material having a dielectric constant that varies across the body of dielectric material in a specific direction; or, both the electrically conductive horn and the body of dielectric material;
wherein the at least one DRA comprises a DRA comprising an elevation view cross section having vertical side walls and a convex top.

12. An electromagnetic device, comprising:
an electrically conductive ground structure;
at least one dielectric resonator antenna (DRA) disposed on the ground structure;
at least one electromagnetic (EM) beam shaper disposed proximate a corresponding one of the DRA; and
at least one signal feed disposed electromagnetically coupled to a corresponding one of the DRA;
wherein the at least one EM beam shaper comprises: an electrically conductive horn; a body of dielectric material having a dielectric constant that varies across the body of dielectric material in a specific direction; or, both the electrically conductive horn and the body of dielectric material;
wherein the at least one DRA comprises a DRA having an overall height and an overall width where the overall height is greater than the overall width.

13. An electromagnetic device, comprising:
an electrically conductive ground structure;
at least one dielectric resonator antenna (DRA) disposed on the ground structure;
at least one electromagnetic (EM) beam shaper disposed proximate a corresponding one of the DRA; and at least one signal feed disposed electromagnetically coupled to a corresponding one of the DRA;

wherein the at least one EM beam shaper comprises: an electrically conductive horn; a body of dielectric material having a dielectric constant that varies across the body of dielectric material in a specific direction; or, both the electrically conductive horn and the body of dielectric material;

wherein each DRA of the at least one DRA comprises:

a volume comprising non-gaseous dielectric material, the volume having a hollow core, a cross sectional overall maximum height Hv as observed in an elevation view, and a cross sectional overall maximum width Wv as observed in a plan view;

wherein the volume is a volume of a single dielectric material composition; and wherein Hv is greater than Wv.

14. An electromagnetic device, comprising:

an electrically conductive ground structure;

at least one dielectric resonator antenna (DRA) disposed on the ground structure;

at least one electromagnetic (EM) beam shaper disposed proximate a corresponding one of the DRA; and at least one signal feed disposed electromagnetically coupled to a corresponding one of the DRA;

wherein the at least one EM beam shaper comprises: an electrically conductive horn; a body of dielectric material having a dielectric constant that varies across the body of dielectric material in a specific direction; or, both the electrically conductive horn and the body of dielectric material;

wherein the at least one EM beam shaper comprises the electrically conductive horn; and the electrically conductive horn comprises side walls that diverge outwards from a first proximal end to a second distal end, the first proximal end disposed in electrical contact with the ground structure, the second distal end disposed at a distance from the associated at least one DRA, the side walls disposed surrounding the corresponding at least one DRA.

15. The device of claim 14, wherein:

the at least one EM beam shaper further comprises the body of dielectric material, the distal end of the electrically conductive horn having an aperture that is equal to or greater than the overall outside dimension of the body of dielectric material.

16. The device of claim 15, wherein:

a length, Lh, of the electrically conductive horn is less than an overall outside dimension, Ds, of the body of dielectric material.

17. The device of claim 15, wherein:

the at least one DRA comprises an array of the at least one DRA to form an array of DRAs; and the array of DRAs is disposed at least partially around the outer surface of the body of dielectric material in a concave arrangement.

18. An electromagnetic device, comprising:

an electrically conductive ground structure;

at least one dielectric resonator antenna (DRA) disposed on the ground structure;

at least one electromagnetic (EM) beam shaper disposed proximate a corresponding one of the DRA; and at least one signal feed disposed electromagnetically coupled to a corresponding one of the DRA;

wherein the at least one EM beam shaper comprises: an electrically conductive horn; a body of dielectric material having a dielectric constant that varies across the body of dielectric material in a specific direction; or, both the electrically conductive horn and the body of dielectric material;

wherein the at least one EM beam shaper comprises the body of dielectric material; and the at least one DRA is at least partially embedded in the body of dielectric material.

19. An electromagnetic device, comprising:

an electrically conductive ground structure;

at least one dielectric resonator antenna (DRA) disposed on the ground structure;

at least one electromagnetic (EM) beam shaper disposed proximate a corresponding one of the DRA; and at least one signal feed disposed electromagnetically coupled to a corresponding one of the DRA;

wherein the at least one EM beam shaper comprises: an electrically conductive horn; a body of dielectric material having a dielectric constant that varies across the body of dielectric material in a specific direction; or, both the electrically conductive horn and the body of dielectric material;

wherein the at least one EM beam shaper comprises the body of dielectric material; and the body of dielectric material comprises a plurality of layers of dielectric materials having different dielectric constants that decrease from a spherical central region of the body of dielectric material to the outer surface of the body of dielectric material.

20. The device of claim 19, wherein:

the body of dielectric material is a spherical shaped dielectric material having a spherical outer surface defined by a spherical radius R; and each DRA of the array of DRAs are disposed such that a far field electromagnetic radiation boresight of the each DRA, when electromagnetically excited, is oriented substantially radially aligned with the spherical radius R.

21. The device of claim 19, wherein:

the body of dielectric material is a toroidal shaped dielectric material having a toroidal outer surface defined by a toroidal radius R1; and each DRA of the array of DRAs are disposed such that a far field electromagnetic radiation boresight of the each DRA, when electromagnetically excited, is oriented substantially radially aligned with the toroidal radius R1.

22. An electromagnetic device, comprising:

an electrically conductive ground structure;

at least one dielectric resonator antenna (DRA) disposed on the ground structure;

at least one electromagnetic (EM) beam shaper disposed proximate a corresponding one of the DRA; and at least one signal feed disposed electromagnetically coupled to a corresponding one of the DRA;

wherein the at least one EM beam shaper comprises: an electrically conductive horn; a body of dielectric material having a dielectric constant that varies across the body of dielectric material in a specific direction; or, both the electrically conductive horn and the body of dielectric material;

wherein the at least one EM beam shaper comprises the body of dielectric material;

wherein the at least one DRA comprises an array of the at least one DRA to form an array of DRAs; and the array of DRAs is disposed at least partially around the outer surface of the body of dielectric material.

23. The device of claim 22, wherein:

the body of dielectric material is a hemispherical shaped dielectric material having a hemispherical outer surface defined by a hemispherical radius R2; and each DRA of the array of DRAs are disposed such that a far field electromagnetic radiation boresight of the each DRA, when electromagnetically excited, is oriented substantially radially aligned with the hemispherical radius R2.

24. The device of claim 22, wherein:

the body of dielectric material is a cylindrical shaped dielectric material having a cylindrical outer surface defined by a cylindrical radius R3; and each DRA of the array of DRAs are disposed such that a far field electromagnetic radiation boresight of the each DRA, when electromagnetically excited, is oriented substantially radially aligned with the cylindrical radius R3.

25. The device of claim 22, wherein:

the body of dielectric material is a hemicylindrical shaped dielectric material having a hemicylindrical outer surface defined by a hemicylindrical radius R4; and each DRA of the array of DRAs are disposed such that a far field electromagnetic radiation boresight of the each DRA, when electromagnetically excited, is oriented substantially radially aligned with the hemicylindrical radius R4.

* * * * *